US006814034B2

(12) United States Patent
Yamada et al.

(10) Patent No.: US 6,814,034 B2
(45) Date of Patent: Nov. 9, 2004

(54) VARIABLE STROKE ENGINE

(75) Inventors: Yoshikazu Yamada, Wako (JP); Yoshikazu Sato, Wako (JP)

(73) Assignee: Honda Motor Co., Ltd., Kawasaki (JP)

( * ) Notice: Subject to any disclaimer, the term of this patent is extended or adjusted under 35 U.S.C. 154(b) by 0 days.

(21) Appl. No.: 10/715,829

(22) Filed: Nov. 19, 2003

(65) Prior Publication Data

US 2004/0149243 A1 Aug. 5, 2004

(30) Foreign Application Priority Data

Nov. 20, 2002 (JP) ..... 2002-336292
Jul. 2, 2003 (JP) ..... 2003-270282

(51) Int. Cl.[7] ..... F02B 75/04
(52) U.S. Cl. ..... 123/48 B; 123/78 E
(58) Field of Search ..... 123/48 R, 48 B, 123/78 R, 78 E, 78 F

(56) References Cited

U.S. PATENT DOCUMENTS 1,786,423 A * 12/1930 Cady ..... 123/78 F
4,517,931 A * 5/1985 Nelson ..... 123/48 B

FOREIGN PATENT DOCUMENTS

EP 1 197 647 A2 10/2001
EP 1 215 380 A2 12/2001
JP 9-228858 9/1997

* cited by examiner

*Primary Examiner*—Noah P. Kamen
(74) *Attorney, Agent, or Firm*—Arent Fox, PLLC.

(57) ABSTRACT

A variable stroke engine includes: a connecting rod connected at one end to a piston through a piston pin; a subsidiary arm turnably connected at one end to the other end of the connecting rod and connected to a crankshaft through a crankpin; and a control rod connected at one end to the subsidiary arm at a position displaced from a connection position of the connecting rod; a support position of the other end of the control rod being capable of being displaced in a plane perpendicular to an axis of the crankshaft. In the variable stroke engine, a switchover means switches over: a state in which a high expansion stroke is provided such that the stroke of the piston in an expansion stroke is larger than that in a compression stroke when an engine load is high; and a state in which a constant compression ratio is provided when the engine load is low. Thus, a reduction in fuel consumption is achieved irrespective of the level of an engine load, while putting a high value on a reduction in fuel consumption in a state in which the engine load is low.

1 Claim, 20 Drawing Sheets

VARIABLE STROKE ENGINE

BACKGROUND OF THE INVENTION

1. Field of the Invention

The present invention relates to a variable stroke engine including: a connecting rod connected at one end to a piston through a piston pin; a subsidiary arm turnably connected at one end to the other end of the connecting rod and connected to a crankshaft through a crankpin; and a control rod connected at one end to the subsidiary arm at a position displaced from a connection position of the connecting rod; a support position of the other end of the control rod being cable of being displaced in a plane perpendicular to an axis of the crankshaft.

2. Description of the Related Art

Such an engine is conventionally known, for example, from Japanese Patent Application Laid-open No. 9-228858, U.S. Pat. No. 4,517,931 and the like, wherein the stroke of a piston in an expansion stroke is made larger than that in a compression stroke, whereby a larger expansion work is carried out in the same amount of an intake air-fuel mixture to enhance the cycle thermal efficiency.

In the above-described conventionally known engine, the stroke of the piston in the expansion stroke is made larger than that in the compression stroke irrespective of the engine load, thereby enhancing the cycle thermal efficiency. However, when the engine load is low, it is desirable that the operation of the engine is carried out while putting a high value on a reduction in fuel consumption.

SUMMARY OF THE INVENTION

The present invention has been accomplished with such circumstance in view, and it is an object of the present invention to provide a variable stroke engine, wherein a reduction in fuel consumption can be achieved irrespective of the level of the engine load, while putting a high value on a reduction in fuel consumption in a state in which the engine load is low.

To achieve the above object, the present invention provides a variable stroke engine including: a connecting rod connected at one end to a piston through a piston pin; a subsidiary arm turnably connected at one end to the other end of the connecting rod and connected to a crankshaft through a crankpin; and a control rod connected at one end to the subsidiary arm at a position displaced from a connection position of the connecting rod; a support position of the other end of the control rod being cable of being displaced in a plane perpendicular to an axis of the crankshaft, wherein the engine further includes a switchover means capable of switching over: a state in which a high expansion ratio is provided such that the stroke of the piston in an expansion stroke is larger than that in a compression stroke when an engine load is high; and a state in which a constant compression ratio is provided when the engine load is low.

With such arrangement of the invention, when the engine load is high, the high expansion ratio is provided, and when the engine load is low, the constant compression ratio is provided. Thus, it is possible to provide a reduction in fuel consumption irrespective of the engine load, while enabling the fuel consumption to be further reduced in the state in which the engine load is low.

DESCRIPTION OF THE PREFERRED EMBODIMENTS

Figure 1:
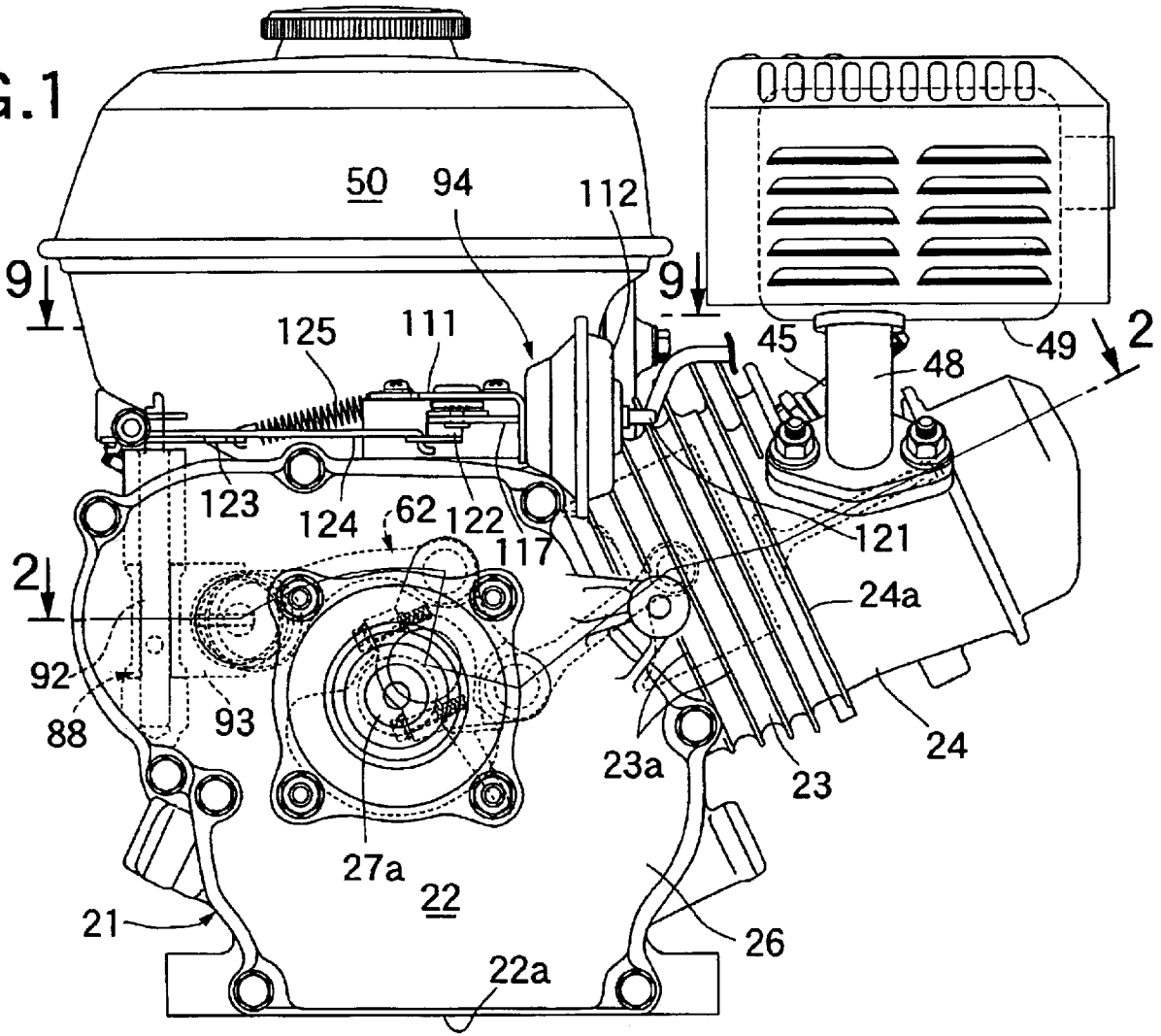
FIG. 1 is a front view of an engine according to a first embodiment of the present invention.
Figure 2:
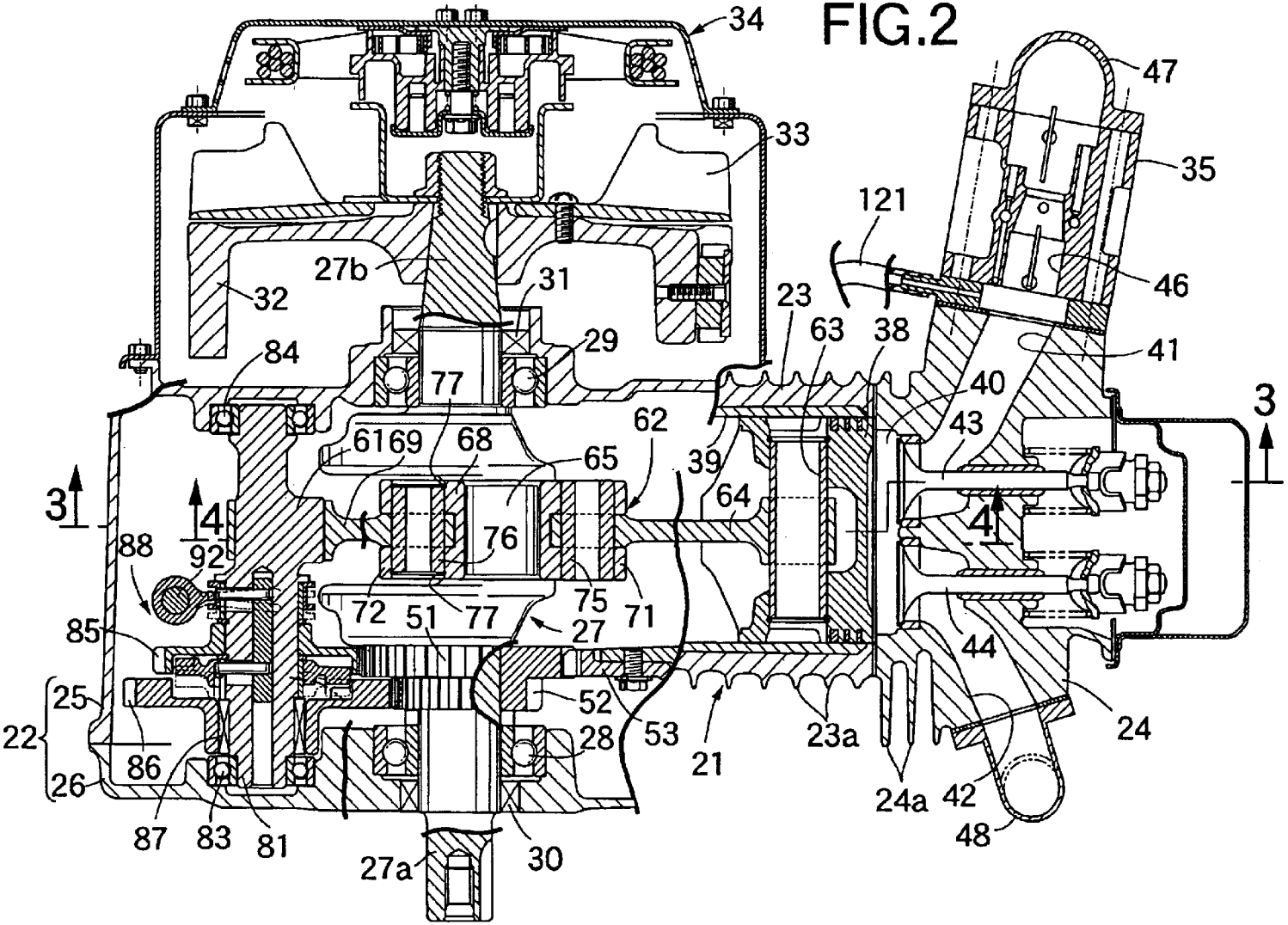
FIG. 2 is a sectional view taken along a line 2—2 in FIG. 1.
Figure 3:
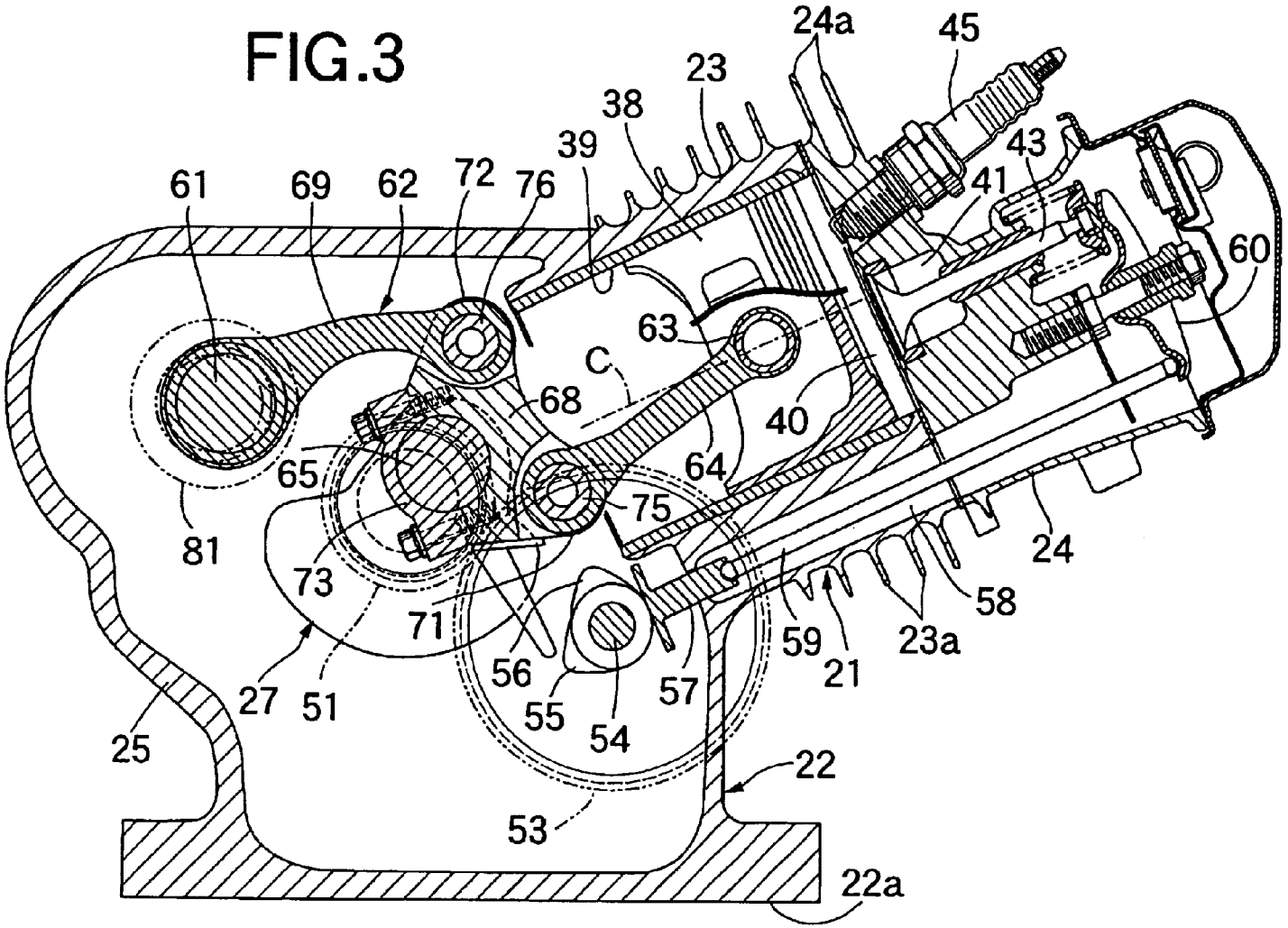
FIG. 3 is a sectional view taken along a line 3—3 in FIG. 2.

Referring first to FIGS. 1 to 3, an engine is a air-cooled single-cylinder engine used in, for example, a working machine or the like, and has an engine body 21 which includes a crankcase 22, a cylinder block 23 slightly inclined upwards and protruding from one side of the crankcase 22, and a cylinder head 24 coupled to a head of the cylinder block 23. A large number of air-cooling fins 23*a* and 24*a* are provided on outer surfaces of the cylinder block 23 and the cylinder head 24. The crankcase 22 is installed, at an installation surface 22*a* on its lower surface, on a cylinder head of any of various working machines.

The crankcase 22 includes a case body 25 formed integrally with the cylinder block 23 by casting, and a side cover 26 coupled to an open end of the case body 25. One end 27*a* of a crankshaft 27 protrudes from the side cover 26. A ball bearing 28 and an oil seal 30 are interposed between the one end 27*a* of the crankshaft 27 and the side cover 26. The other end 27*b* of the crankshaft 27 protrudes from the case body 25. A ball bearing 29 and an oil seal 31 are interposed between the other end 27*b* of the crankshaft 27 and the case body 25.

A flywheel 32 is secured to the other end 27*b* of the crankshaft 27 outside the case body 25. A cooling fan 33 for supplying cooling air to various portions of the engine body 21 is secured to the flywheel 32. A recoil starter 34 is disposed outside the cooling fan 33.

A cylinder bore 39 is formed in the cylinder block 23. A piston 38 is slidably received in the cylinder bore 39. A combustion chamber 40 is formed between the cylinder block 23 and the cylinder head 24, so that a top of the piston 38 faces the combustion chamber 40.

An intake port 41 and an exhaust port 42 capable of leading to the combustion chamber 40 are formed in the cylinder head 24. An intake valve 43 for connecting and disconnecting the intake port 41 and the combustion chamber 40 to and from each other and an exhaust valve 44 for connecting and disconnecting the exhaust port 42 and the combustion chamber 40 to and from each other are openably and closably disposed in the cylinder head 24. A spark plug 45 is threadedly mounted to the cylinder head 24 with its electrode facing the combustion chamber 40.

A carburetor 35 is connected to an upper portion of the cylinder head 24. A downstream end of an intake passage 41 of the carburetor 35 communicates with the intake port 41. An intake pipe 47 leading to an upstream end of the intake passage 46 is connected to the carburetor 35, and also connected to an air cleaner which is not shown. An exhaust pipe 48 leading to the exhaust port 42 is connected to an upper portion of the cylinder head 24, and also connected to an exhaust muffler 49. Further, a fuel tank 51 is disposed above the crankcase 22 while being supported on the crankcase 22.

A driving gear 51 and a second driving gear 52 integral with the first driving gear 51 and having an outer diameter equal to ½ of that of the first driving gear 51, are fixedly mounted on the crankshaft 27 at positions closer to the side cover 26 of the crankcase 22. A first driven gear 53 meshed with the first driving gear 51 is secured to a camshaft 54 which is rotatably carried in the crankcase 22 and which has an axis parallel to the crankshaft 27. Thus, a rotating power from the crankshaft 27 is transmitted at a reduction ratio of 1/2 to the camshaft 54 by the first driving gear 51 and the first driven gear 53 meshed with each other.

An intake cam 55 and an exhaust cam 56 corresponding to the intake valve 43 and the exhaust valve 44 respectively are provided on the camshaft 54. A follower piece operably carried in the cylinder block 23 is in sliding contact with the intake cam 55. On the other hand, an operating chamber 58 is formed in the cylinder block 23 and the cylinder head 24, so that an upper portion of the follower piece 57 protrudes into a lower portion of the operating chamber 58. A lower end of a pushrod 59 disposed in the operating chamber 58 is in abutment against the follower piece 57. On the other hand, a rocker arm 60 is swingably carried in the cylinder head 24 with one end abutting against an upper end of the intake valve 43 biased in a closing direction by a spring. An upper end of the pushrod 59 is in abutment against the other end of the rocker arm 60. Thus, the pushrod 59 is operated axially in response to the rotation of the intake cam 55. The intake valve 43 is opened and closed by the swinging movement of the rocker arm caused in response to the operation of the pushrod 59.

A mechanism similar to that between the intake cam 55 and the intake valve 43 is also interposed between the exhaust cam 56 and the exhaust valve 44, so that the exhaust valve 44 is opened and closed in response to the rotation of the exhaust cam 56.

Figure 4:
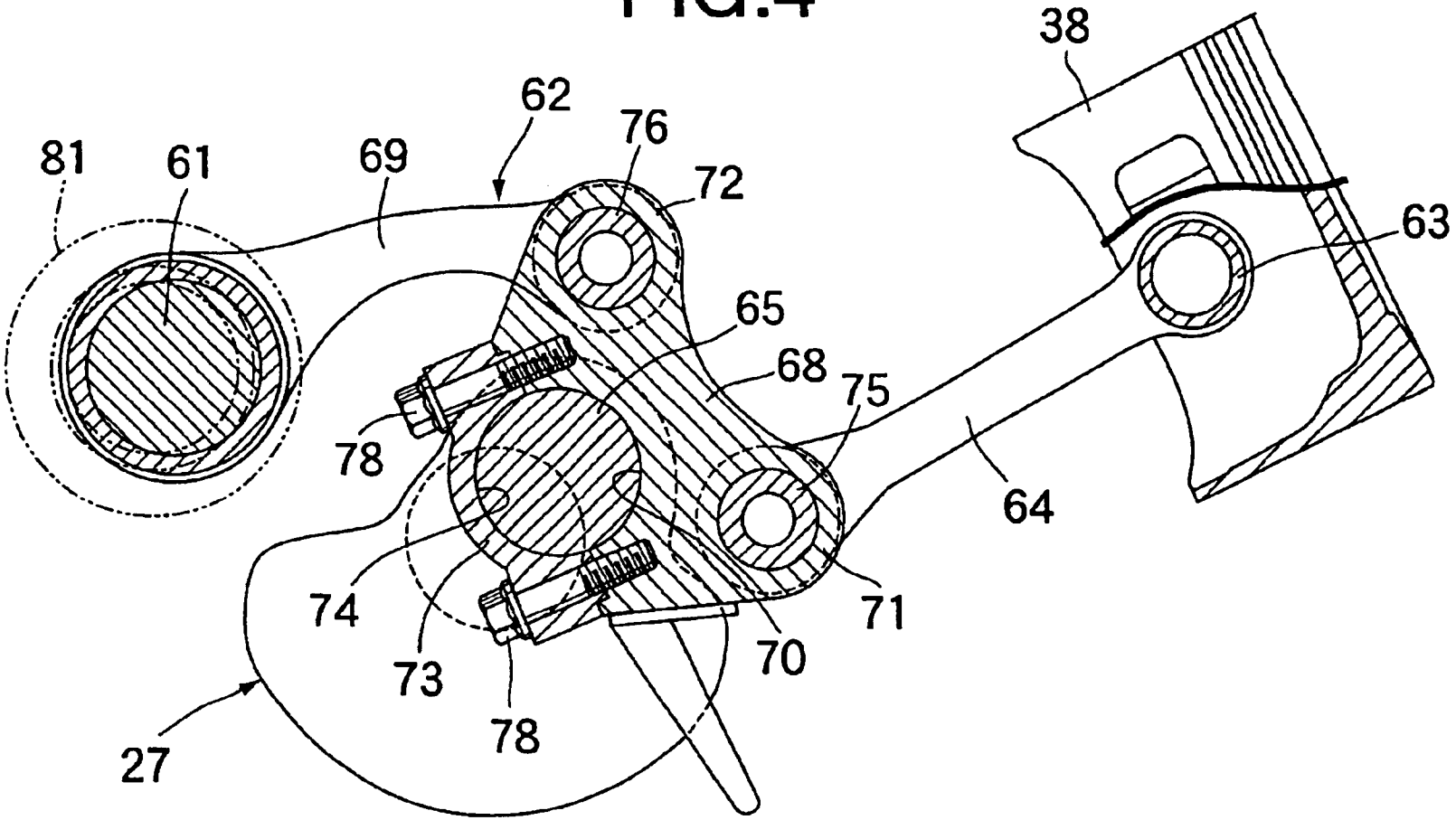
FIG. 4 is a sectional view taken along a line 4—4 in FIG. 3.

Referring also to FIG. 4, the piston 38, the crankshaft 27 and an eccentric shaft 61 carried in the crankcase 22 of the engine body 21 for displacement in a plane passing through a cylinder axis C and perpendicular to the axis of the crankshaft 27, are connected to one another through a link mechanism 62.

The link mechanism 62 includes: a connecting rod 64 connected at one end to the piston 38 through a piston pin 63; a subsidiary rod 68 connected to the crankshaft 27 through a crankpin 65 and turnably connected to the other end of the connecting rod 64; and a control rod 69 which is turnably connected at one end to the subsidiary rod 68 at a position displaced from a connection position of the connecting rod 64. The control rod 69 is turnably supported at the other end on the eccentric shaft 61 so that the support position can be displaced in a plane perpendicular to the axis of the crankshaft 27.

Figure 5:
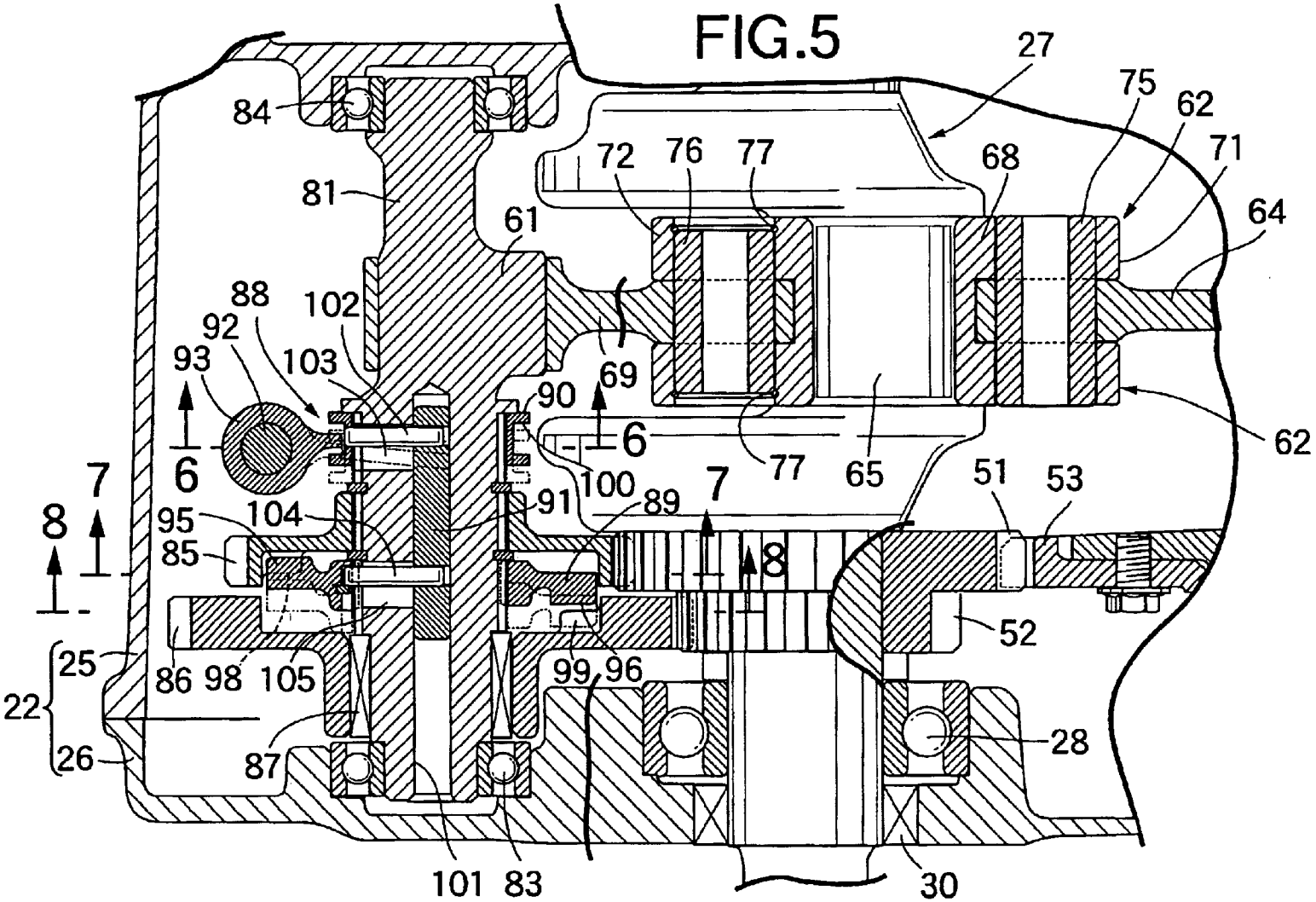
FIG. 5 is an enlarged view of essential portions of FIG. 2.

Referring also to FIG. 5, the subsidiary rod 68 has, at its intermediate portion, a first semicircular bearing portion 70 which is in sliding contact with a half of a periphery of the crankpin 65. A pair of bifurcations 71 and 72 are provided integrally at opposite ends of the subsidiary rod 68, so that the other end of the connecting rod 64 and one end of the control rod 69 are sandwiched between the bifurcations 71 and 72. A second semicircular bearing portion 74 of a crank cap 73 is in sliding contact with the remaining half of the periphery of the crankpin 65. The crank cap 73 is fastened to the subsidiary rod 68.

The connecting rod 64 is turnably connected at the other end to one end of the subsidiary rod 68 through a cylindrical connecting rod pin 75. The subsidiary rod pin 75 press-fitted into the other end of the connecting rod 64 is turnably fitted at its opposite ends into the bifurcation 71 located at the one end of the subsidiary rod 68.

The control rod 69 is turnably connected at one end to the other end of the subsidiary rod 68 through a cylindrical connecting rod pin 76. The connecting rod pin 76 is relatively turnably passed through one end of the control rod 69 which is inserted into the bifurcation 72 located at the other end of the subsidiary rod 68. The connecting rod pin 76 is clearance-fitted at its opposite ends into the bifurcation 72 located at the other end. Moreover, a pair of clips 77, 77 are mounted to the bifurcation 72 located at the other end, and abuts against opposite ends of the subsidiary rod pin 76 to inhibit the disengagement of the subsidiary rod pin 76 from the bifurcation 72.

Further, the crank cap 73 is fastened to the bifurcations 71 and 72 by pairs of bolts 78 disposed on opposite sides of the crankshaft 27. The connecting rod pin 75 and the subsidiary rod pin 76 are disposed on extensions of axes of the bolts 78.

The cylindrical eccentric shaft 61 is integrally provided at an eccentric position on a rotary shaft 81 turnably carried in the crankcase 22 of the engine body 21 and having an axis parallel to the crankshaft 27. The rotary shaft 81 is turnably carried at one end on the side cover 26 of the crankcase 22 with a ball bearing 83 interposed therebetween, and also carried at the other end on the case body 25 of the crankcase 22 with a ball bearing 84 interposed therebetween.

A second driven gear 85 formed to have the same diameter as the first driving gear 51 and meshed with the first driving gear 51 is relatively rotatably carried on the rotary shaft 81. A third driven gear 86 meshed with the second riving gear 52 and having an outer diameter two times that of the second driving gear 52 is mounted on the rotary shaft 81 through a one-way clutch 87. The one-way clutch 87 permits the transmission of the rotating power from the third driven gear 86 to the rotary shaft 81, but disables the transmission of the rotating power from the rotary shaft 81 to the third driven gear 86.

The following states are switched over from one to another by a switchover means 88: a state in which the power is transmitted from the crankshaft 27 through the second driving gear 52, the third driven gear 86 and the one-way clutch 87 to the rotary shaft 81, i.e., a state in which the rotating power is transmitted at a reduction ratio of 1/2 from the crankshaft 27 to the rotary shaft 81; and a state in which the power is transmitted from the crankshaft 27 through the first driving gear 51 and the second driven gear 85 to the rotary shaft 81, i.e., a state in which the rotating power is transmitted at a constant speed from the crankshaft 27 to the rotary shaft 81. The switchover means 88 is adapted to switch over the following states in accordance with the engine load: a state in which the rotating power is transmitted at the reduction ratio of 1/2 from the crankshaft 27 to the rotary shaft 81 in order to provide a high expansion ratio in which the stroke of the piston 38 in an expansion stroke is larger than that in a compression stroke when the engine load is high; and a state in which the rotating power is transmitted at a constant speed from the crankshaft 27 to the rotary shaft 81 in order to provide a constant compression ratio when the engine load is low.

Figure 6:
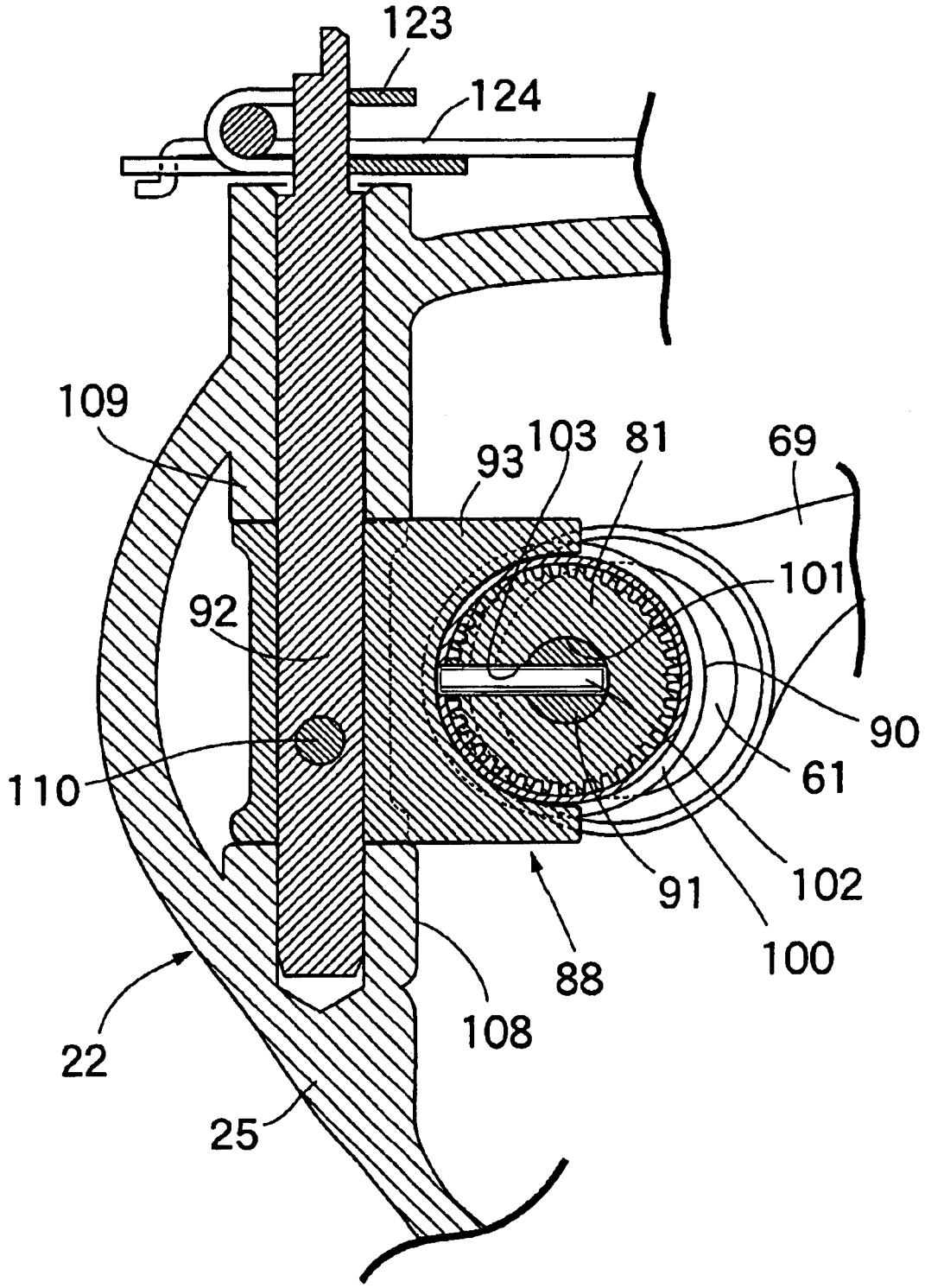
FIG. 6 is an enlarged sectional view taken along a line 6—6 in FIG. 5.

Referring also to FIG. 6, the switchover means 88 includes: a ratchet slider 89 which is carried axially slidably and relatively non-rotatably about an axis on the rotary shaft 81 so that it is brought alternatively into engagement with one of the second and third driven gears 85 and 86; a shifter 90 which is carried axially slidably and relatively non-rotatably about an axis on the rotary shaft 81; a transmitting shaft 91 which is axially slidably fitted into the rotary shaft 81 so that the axial movement of the shifter 90 is transmitted to the ratchet slider 89; a turn shaft 92 carried in the case body 25 of the crankcase 22 for turning about an axis perpendicular to the rotary shaft 81; a shift fork 93 fixed to the turn shaft 92 to embrace the shifter 90; and a diaphragm-type actuator 94 connected to the turn shaft 92.

Figure 7:
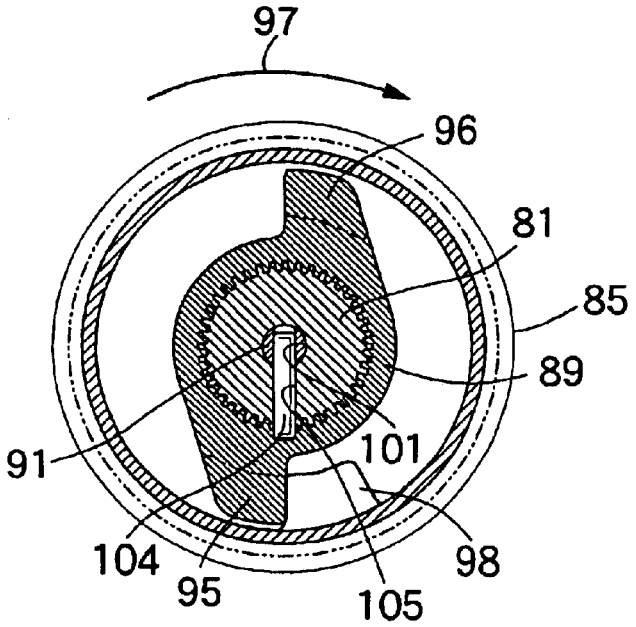
FIG. 7 is an enlarged sectional view taken along a line 7—7 in FIG. 5.
Figure 8:
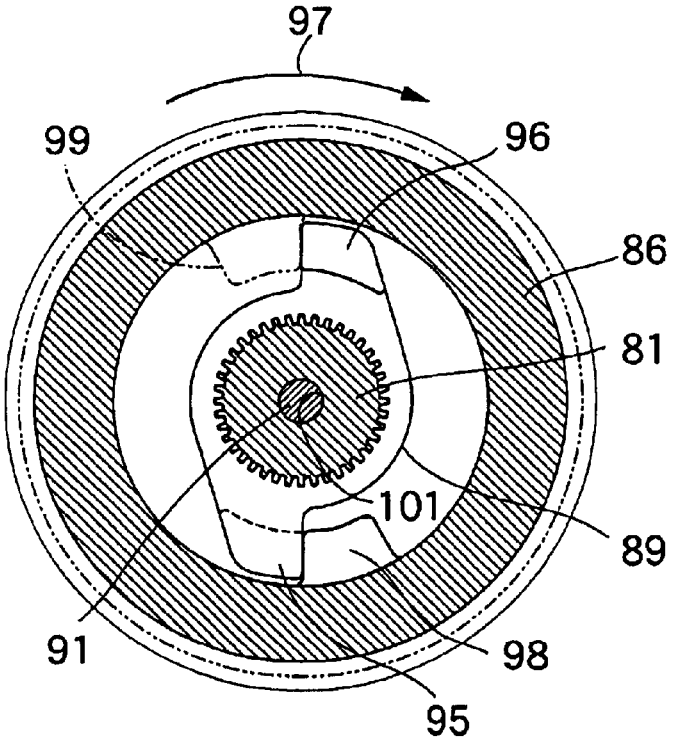
FIG. 8 is a sectional view taken along a line 8—8 in FIG. 5.

Referring to FIGS. 7 and 8, the ratchet slider 89 is spline-coupled to the rotary shaft 81 between the second and third gears 85 and 86. A first engagement projection 95 is integrally provided on a face of the ratchet slider 89 which is opposed to the second driven gear 85. A second engagement projection 96 is integrally provided on a face of the ratchet slider 89 which is opposed to the third driven gear 86.

On the other hand, the second driven gear 85 is integrally provided with a first locking portion 98 which is adapted to be brought into engagement with the first engagement projection 95 of the ratchet slider 89 slid toward the second driven gear 85 in response to the rotation of the second driven gear 85 in a rotational direction shown by an arrow 97 by the transmission of the rotating power from the crankshaft 27. The third driven gear 86 is integrally provided with a second locking portion 99 which is adapted to be brought into engagement with the second engagement projection 96 of the ratchet slider 89 slid toward the third driven gear 86 in response to the rotation of the third driven gear 86 in a rotational direction shown by an arrow 97 by the transmission of the rotating power from the crankshaft 27.

Namely, when the ratchet slider 89 is slid toward the second driven gear 85, the rotating power from the crankshaft 27 is transmitted at a constant speed through the first driving gear 51, the second driven gear 85 and the ratchet slider 89 to the rotary shaft 81. In this process, the third driven gear 86 is raced by the action of the one-way clutch 87. When the ratchet slider 89 is slid toward the third driven gear 86, the rotating power from the crankshaft 27 is reduced at a reduction ratio of 1/2 and transmitted through the second driving gear 52, the third driven gear 86 and the ratchet slider 89 to the rotary shaft 81. In this process, the second driven gear 85 is raced.

The shifter 90 is spline-coupled to the rotary shaft 81 at a position where the second driven gear 85 is sandwiched between the shifter 90 and the ratchet slider 89. An annular groove 100 is provided around an outer periphery of the shifter 90.

A slide bore 101 is provided in the rotary shaft 81 to coaxially extend from one end of the rotary shaft 81 to a point corresponding to the shifter 90. The transmitting shaft 91 is slidably fitted in the slide bore 101. The transmitting shaft 91 and the shifter 90 are connected to each other by a connecting pin 102 having an axis extending along one diametrical line of the rotary shaft 81, so that the transmitting shaft 91 is slid axially in the slide bore 101 in response to the axial sliding of the shifter 90. Moreover, an elongated bore 103 for permitting the movement of the connecting pin 102 in response to the axial sliding of the shifter 90 and the transmitting shaft 91 is provided in the rotary shaft 81 so that the connecting pin 102 is inserted through the elongated bore 103. Further, the transmitting shaft 91 and the ratchet slider 89 are connected to each other by a connecting pin 104 having an axis extending along one diametrical line of the rotary shaft 81, so that the ratchet slider 89 is slid axially in response to the axial movement of the transmitting shaft 91. Moreover, an elongated bore 105 for permitting the movement of the connecting pin 104 in response to the axial sliding of the transmitting shaft 91 and the ratchet slider 89 is provided in the rotary shaft 81 so that the connecting pin 104 is inserted through the elongated bore 105.

A bottomed cylindrical shaft-supporting portion 108 and a cylindrical shaft-supporting portion 109 are integrally provided on the case body 25 of the crankcase 22 so that they are opposed to each other at a distance on the same axis perpendicular to the axis of the rotary shaft 81. The turn shaft 92 with one end disposed on the side of the shaft-supporting portion 108 is turnably carried on the shaft-supporting portions 108 and 109, and the other end of the turn shaft 92 protrudes outwards from the shaft-supporting portion 109.

The shift fork 93 is fixed to the turn shaft 92 between the shaft-supporting portions 108 and 109 by a pin 110, and engaged in the annular groove 100 in the shifter 90. Therefore, the shifter 90 is slid in an axial direction of the rotary shaft 81 by turning the shift fork 93 along with the turn shaft 92, whereby the alternative engagement of the ratchet slider 89 with the second or third driven gears 85 or 86 is switched over.

Figure 9:
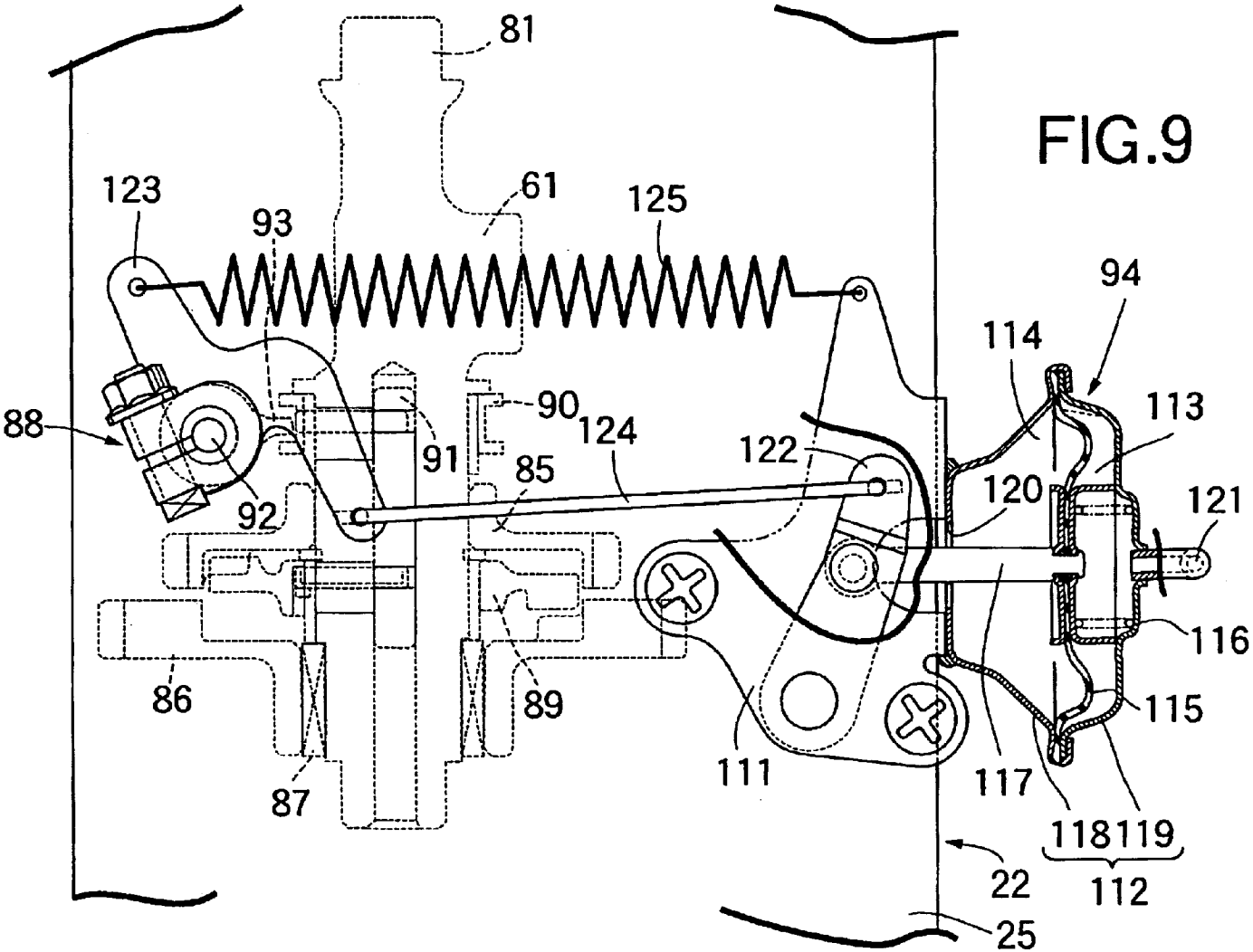
FIG. 9 is a partially cutaway plan view taken along a line 9—9 in FIG. 1 in a low load state of the engine.

Referring also to FIG. 9, the actuator 94 includes: a casing 112 mounted to a support plate 111 fastened to an upper portion of the case body 25 of the crankcase 22; a diaphragm 115 supported in the casing 112 to partition the inside of the casing 112 into a negative pressure chamber 113 and an atmospheric pressure chamber 114; a spring 116 mounted under compression between the casing 112 and the diaphragm 115 to exhibit a spring force in a direction to increase the volume of the negative pressure chamber 113; and an actuating rod 117 connected to a central portion of the diaphragm 115.

The casing 112 includes: a bowl-shaped first case half 118 mounted to the support plate 111; and a bowl-shaped second case half 119 connected by crimping to the case half 118. A peripheral edge of the diaphragm 115 is clamped between open ends of the case halves 118 and 119. The negative pressure chamber 113 is defined between the diaphragm 115 and the second case half 119, and accommodates the spring 116 therein.

The atmospheric pressure chamber 114 is defined between the diaphragm 115 and the first case half 118. The actuating rod 117 protrudes into the atmospheric pressure chamber 114 through a through-bore 120 provided in a central portion of the first case half 118, and is connected at one end to a central portion of the diaphragm 115. The atmospheric pressure chamber 114 communicates with the outside through a clearance between an inner periphery of the through-bore 120 and an outer periphery of the actuating rod 117.

A conduit 121 leading to the negative pressure chamber 113 is connected to the second case half 119 of the casing 112, and also connected to a downstream end of the intake passage 46 in the carburetor 35. Namely, an intake negative pressure in the intake passage 46 is introduced into the negative pressure chamber 113 in the actuator 94.

The other end of the actuating rod 117 of the actuator 94 is connected to a driving arm 122 carried on the support plate 111 for turning about an axis parallel to the turn shaft 92. A driven arm 123 is fixed to the other end of the turn shaft 92 protruding from the crankcase 22. The driving arm 122 and the driven arm 123 are connected to each other through a connecting rod 124. A spring 125 is mounted between the driven arm 123 and the support plate 111 for biasing the driven arm 123 to turn in a clockwise direction in FIG. 9.

When the engine is in a low-load operational state in which the negative pressure in the negative pressure chamber 113 is high, the diaphragm 115 is flexed to decrease the volume of the negative pressure chamber 113 against spring forces of the return spring 116 and the spring 125, so that the actuating rod 117 is contracted, as shown in FIG. 9. In this state, the turned positions of the turn shaft 92 and the shift fork 93 are positions in which the first engagement projection 95 of the ratchet slider 89 is in abutment and engagement with the first locking portion of the second driven gear 85.

Figure 10:
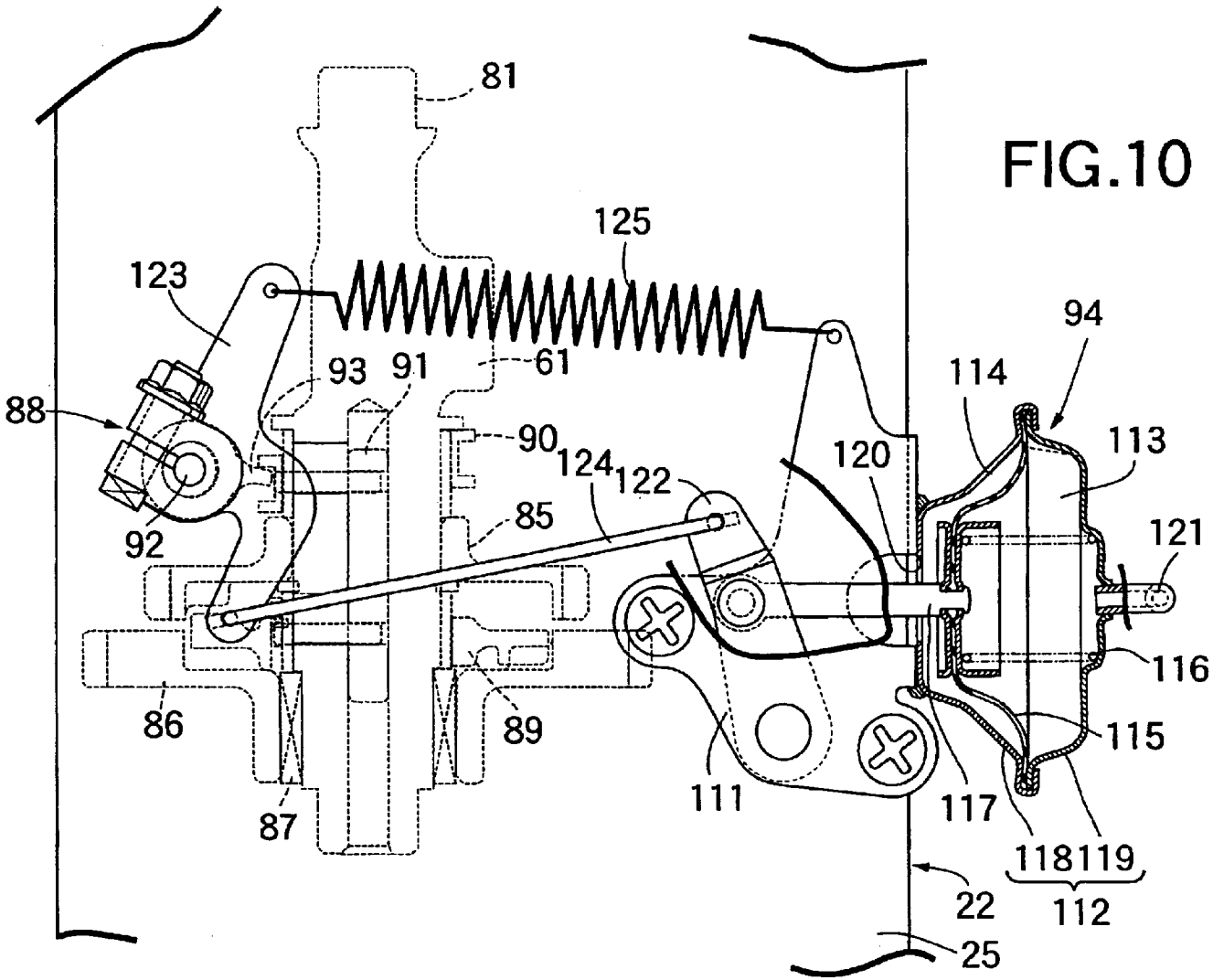
FIG. 10 is a view similar to FIG. 9, but in a high load state of the engine.

On the other hand, when the engine is brought into a high-load operational state in which the negative pressure in the negative pressure chamber 113 is low, the diaphragm 115 is flexed to increase the volume of the negative pressure chamber 113 by the spring forces of the return spring 116 and the spring 125, so that the actuating rod 108 is expanded, as shown in FIG. 10. Thus, the turn shaft 92 and the shift fork 93 are turned to the positions at which the second engagement projection 96 of the ratchet slider 89 is in abutment and engagement with the second locking portion 99 of the third driven gear 86.

By turning the shift fork 93 by the actuator 94 in the above manner, the rotating power from the crankshaft 27 is transmitted at the constant speed to the rotary shaft 81 during the low-load operation of the engine, and the rotating power from the crankshaft 27 is reduced at the reduction ratio of 1/2 and transmitted to the rotary shaft 81 during the high-load operation of the engine.

The operation of the first embodiment will be described below. During the high-load operation of the engine, the eccentric shaft 61 is rotated at a rotational speed equal to ½ of that of the crankshaft 27 about the axis of the rotary shaft 81. Therefore, the position of the other end of the control rod 69 in the link mechanism 62 can be displaced at 180 degree about the axis of the rotary shaft 81 in the expansion stroke and the compression stroke, thereby providing a high expansion ratio in which the stroke of the piston 38 in the expansion stroke is larger than that in the compression stroke, when the engine load is high.

On the other hand, during the low-load operation of the engine, the eccentric shaft 61 is rotated at the speed equal to that of the crankshaft 27 about the axis of the rotary shaft 81. Therefore, when the engine load is low, the stroke of the piston 38 can be made constant, and the compression ratio can be made constant.

Figure 11:
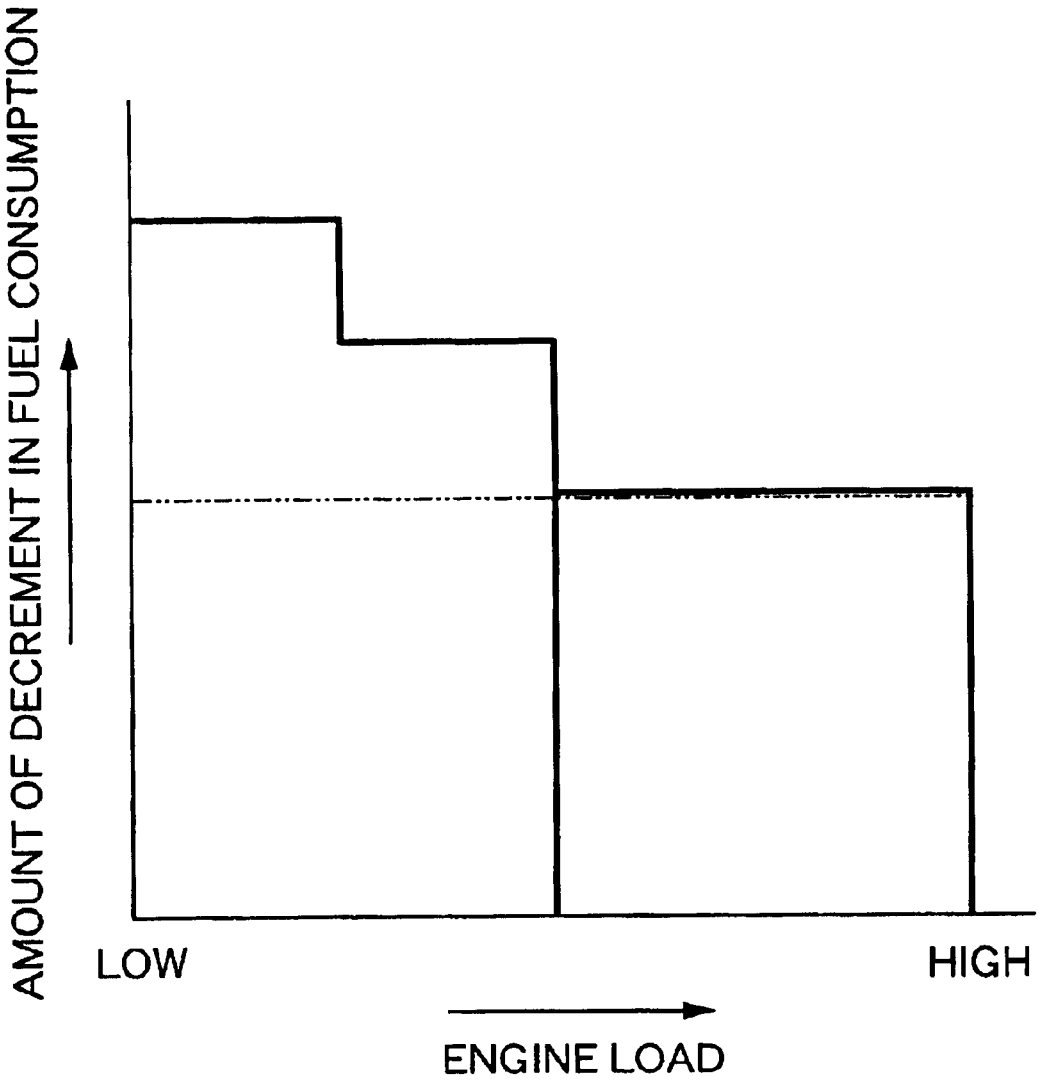
FIG. 11 is a graph showing the relationship between the engine load and the amount of decrement in fuel consumption.
Figure 12:
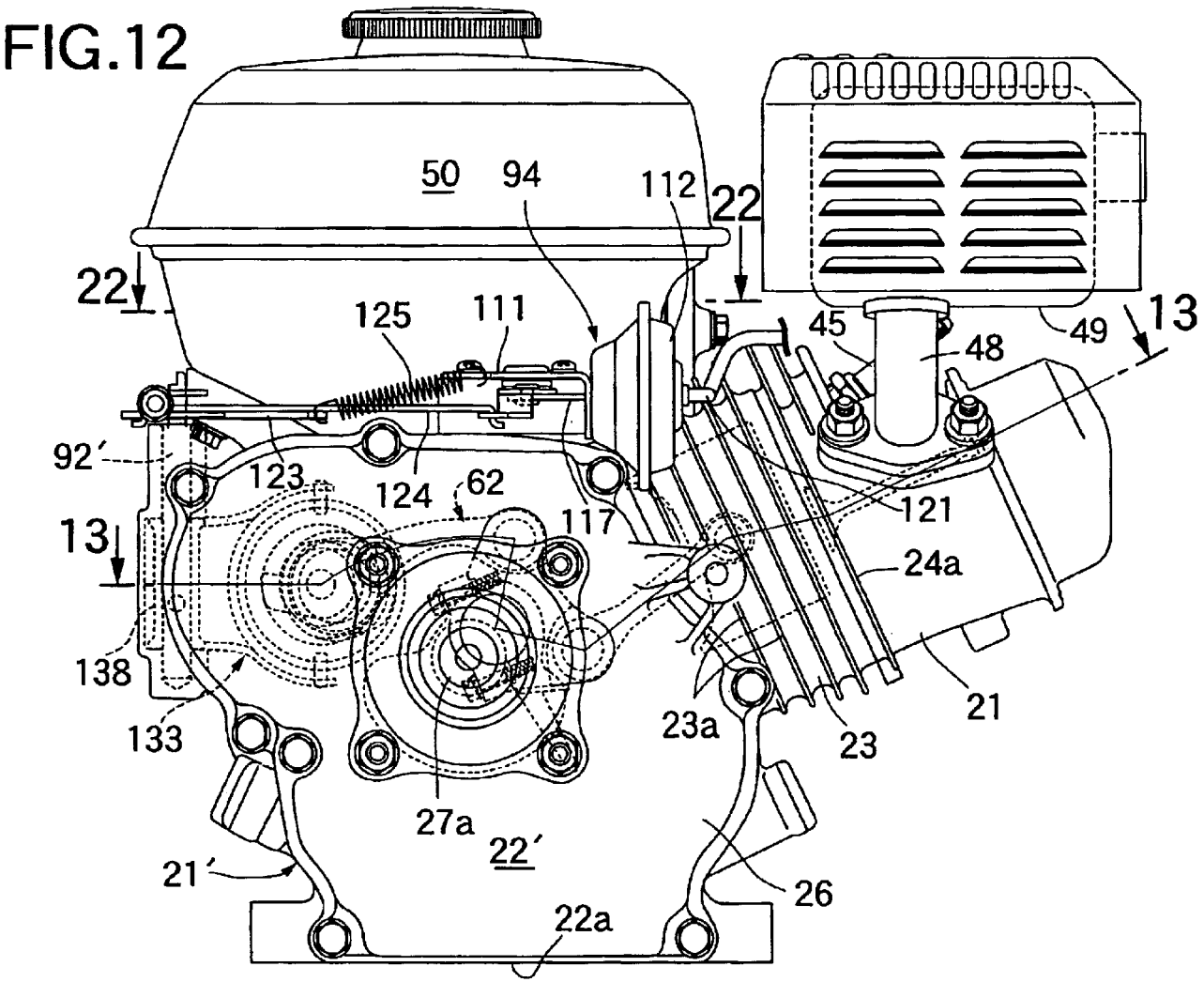
FIG. 12 is a front view of an engine according to a second embodiment of the present invention.
Figure 13:
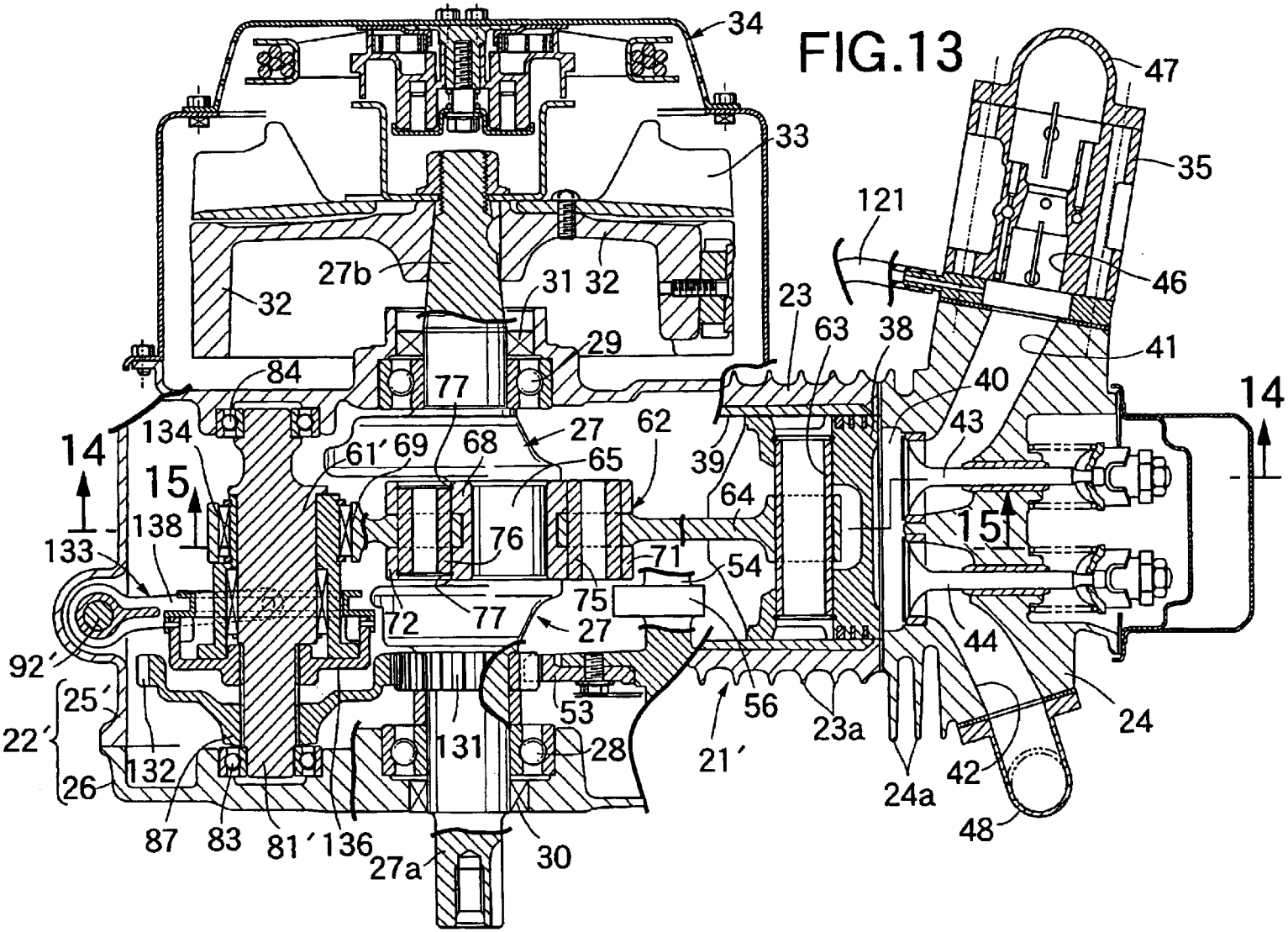
FIG. 13 is a sectional view taken along a line 13—13 in FIG. 12.
Figure 14:
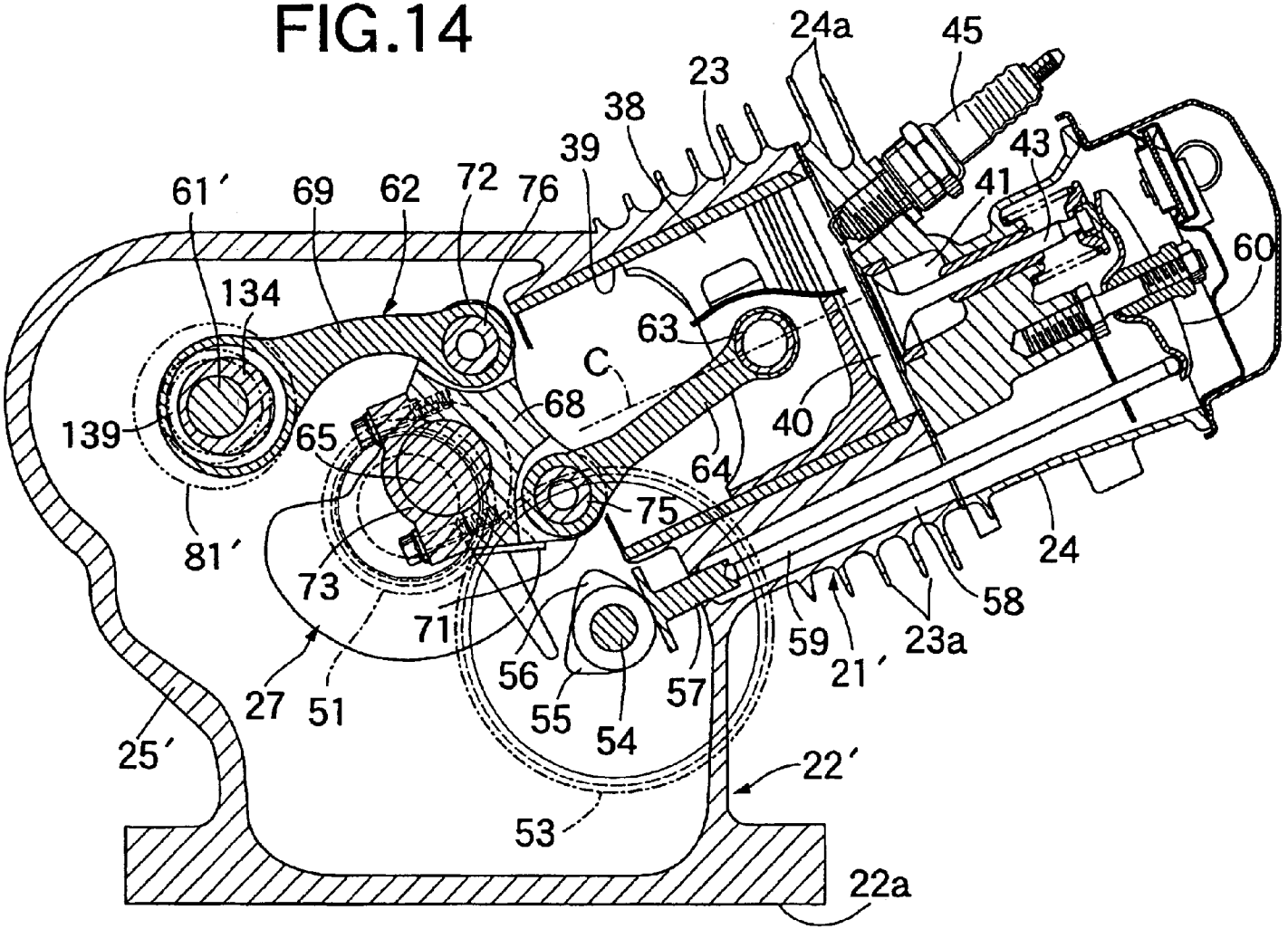
FIG. 14 is a sectional view taken along a line 14—14 in FIG. 13.
Figure 15:
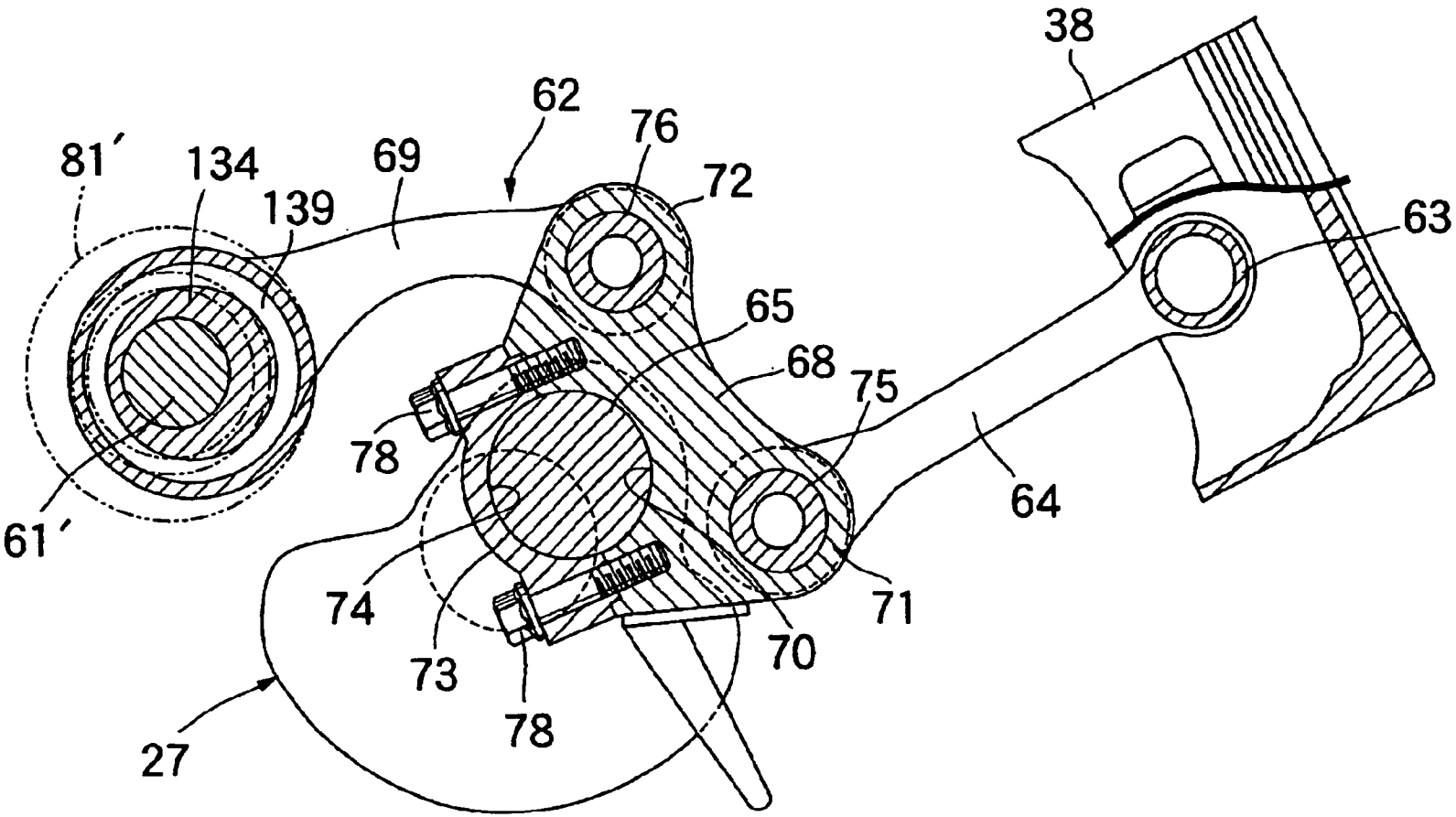
FIG. 15 is a sectional view taken along a line 15—15 in FIG. 13.
Figure 16:
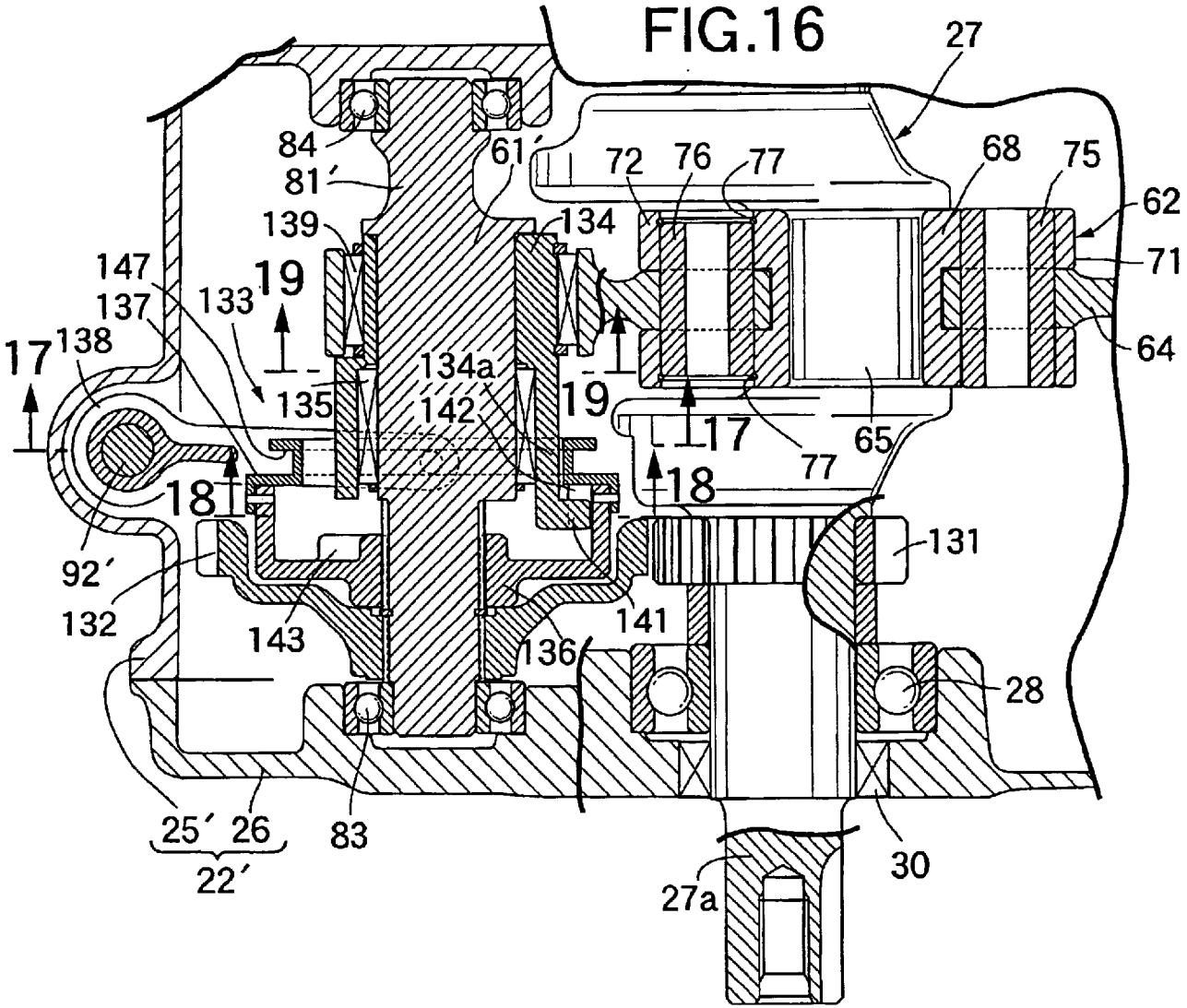
FIG. 16 is an enlarged view of essential portions of FIG. 13.

If the high-load ratio operation, in which the stroke of the piston in the expansion stroke is larger than that in the compression stroke irrespective of the engine load, is carried out, the amount of decrement in fuel consumption can be relatively increased irrespective of the engine load, as shown by a dashed line in FIG. 11. However, according to the present invention, if the compression ratio is made constant when the engine load is low, the fuel consumption can be further reduced in a state in which the engine load is low, as shown by a solid line in FIG. 11. Thus, it is possible to further reduce the fuel consumption, when the load of the engine is low, while providing a reduction in fuel consumption in a state in which the engine load is high.

FIGS. 12 to 23 show a second embodiment of the present invention. In the description of the second embodiment of the present invention with reference to FIGS. 12 to 23, portions or components corresponding to those in the first embodiment shown in FIGS. 1 to 11 are designated by the same numerals and symbols, and the detailed description of them is omitted.

Referring to FIGS. 12 to 16, a crankshaft 22' of an engine body 21' includes a case body 25' formed integrally with a cylinder block 23 by casting, and a side cover 26 coupled to an open end of the case body 25'. A third driving gear 131 is fixedly mounted on the crankshaft 27 at a position closer to the side cover 26 of the crankcase 22', and meshed with the first driven gear 53 secured to the camshaft 54. Thus, the rotating power from the crankshaft 27 is transmitted at a reduction ratio of 1/2 to the camshaft 54 by the third driving gear 131 and the first driven gear 53 meshed with each other.

A piston 38 and the crankshaft 27 are connected to the each other through a link mechanism 62. The link mechanism 62 includes: a connecting rod 64 connected at one end to the piston 38 through a piston pin 63; a subsidiary rod 68 connected to the crankshaft 27 through a crank pin 65 and also turnably connected to the other end of the connecting rod 64; and a control rod 69 turnably connected at one end to the subsidiary rod 68 at a position displaced from a connection position of the connecting rod 64. The other end of the control rod 69 is turnably supported at a support position capable of being displaced in a plane perpendicular to the axis of the crankshaft 27.

An eccentric shaft 61' is integrally provided at an eccentric position on a rotary shaft 81 which is rotatably carried in the crankcase 22' of the engine body 21' with ball bearings 83 and 84 interposed therebetween and which has an axis parallel to the crankshaft 27. The eccentric shaft 61' is relatively rotatably passed through the other end of the control rod 69.

A fourth driven gear 132 having an outer diameter two times that of the third driving gear 131 and adapted to be meshed with the third driving gear 131, is relatively non-rotatably mounted on the rotary shaft 81'. Thus, during operation of the engine, the rotating power from the crankshaft 27 is always transmitted at a reduction ratio of 1/2 to the rotary shaft 81'.

The support center of the other end of the control rod 69 in the link mechanism 62 is switched over by a switchover means 133 between a state in which it has been displaced from the axis of the rotary shaft 81', i.e., from the rotational center in a plane perpendicular to the axis of the rotary shaft 81', and a state in which it is aligned with the axis of the rotary shaft 81', i.e., from the rotational center. The switchover means 133 is adapted to switch over the following states in accordance with the engine load: a state in which the support center of the other end of the control rod 69 is displaced from the rotational center of the rotary shaft 81' in order to provide a high expansion ratio in which the stroke of the piston 38 in an expansion stroke is larger than that in a compression stroke when the engine load is high; and a state in which the support center of the other end of the control rod 69 is aligned with the rotational center of the rotary shaft 81' in order to provide a constant compression ratio when the engine load is low.

Figure 17:
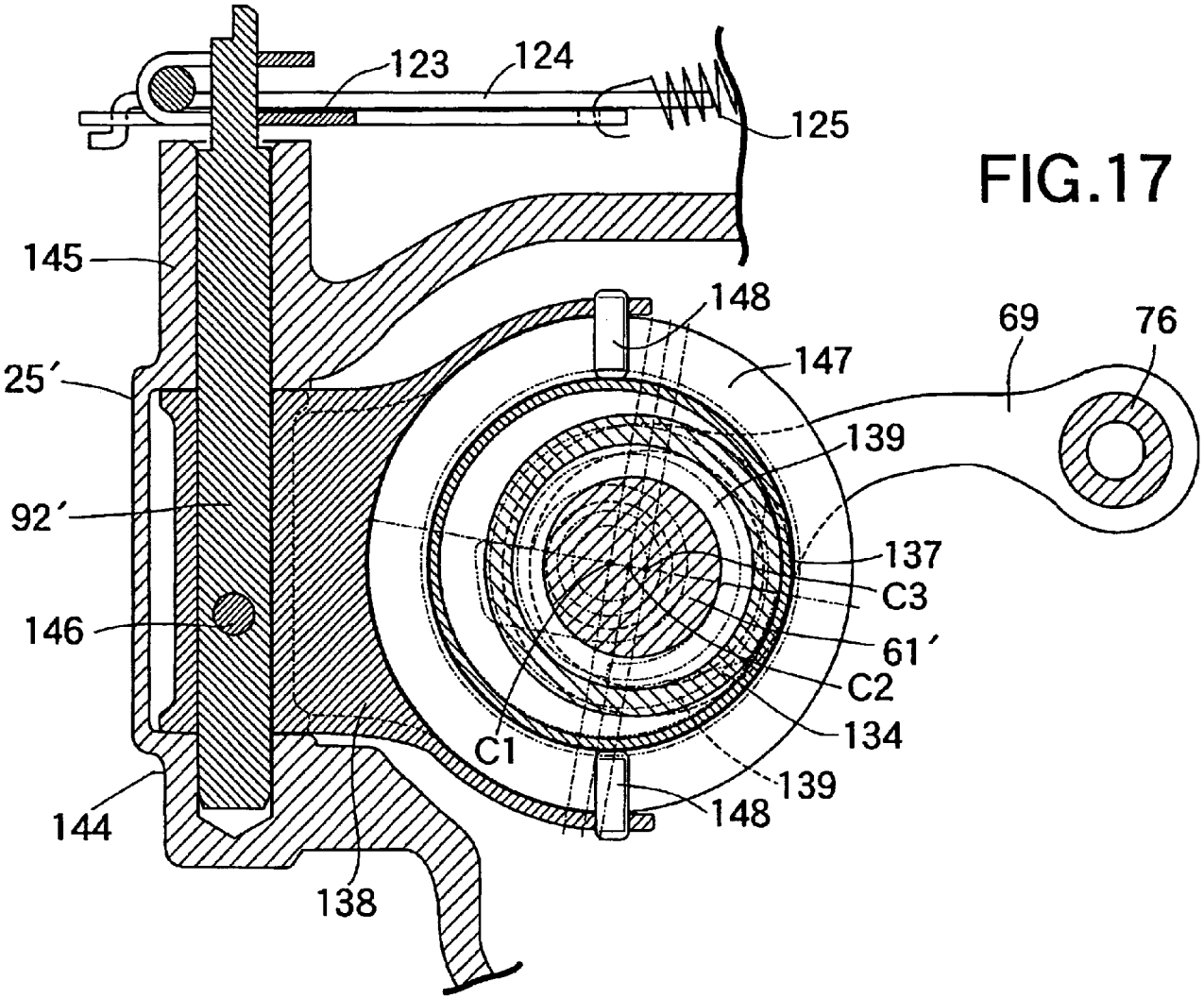
FIG. 17 is an enlarged sectional view taken along a line 17—17 in FIG. 16.

Referring also to FIG. 17, the switchover means 133 includes: an eccentric sleeve 134 having an outer periphery which is eccentric from the eccentric shaft 61' and surrounding the eccentric shaft 61'; a one-way clutch 139 interposed between the eccentric sleeve 134 and the eccentric shaft 61'; a ratchet slider 136 which is carried on the rotary shaft 81' for sliding in an axial direction and for relative non-rotation about an axis, so that it can be brought into engagement with the eccentric sleeve 134 alternatively at two points whose rotated phases are different from each other; a shifter 137 relatively non-rotatably connected to the ratchet slider 136 and surrounding the eccentric sleeve 134; a turn shaft 92' carried in the case body 25' of the crankcase 22' for turning about an axis perpendicular to the rotary shaft 81'; a shift fork 138 fixed to the turn shaft 92' and connected to the shifter 137; and a diaphragm-type actuator 94 connected to the turn shaft 92'. The one-way clutch 139 is interposed between the other end of the control rod 69 in the link mechanism 62 and the eccentric sleeve 134.

When the other end of the control rod 69 is turned about the eccentric sleeve 134 in response to the sliding of the piston 38 in the cylinder bore 39, the one-way clutch 139 transmits the turning force, in a direction opposite from the a direction 140 of the rotation of the rotary shaft 81', from the control rod 69 to the eccentric sleeve 134, but does not transmit the turning force in the same direction as the rotational direction 140 from the control rod 69 to the eccentric sleeve 134, nor the turning power from the rotary shaft 81' to the eccentric sleeve 134.

The eccentric sleeve 134 is integrally provided with a cylindrical portion 134*a* which extends coaxially with the eccentric shaft 61' and towards the ratchet slider 136. The one-way clutch 139 is interposed between the cylindrical portion 134*a* and the eccentric shaft 61'.

A load in a direction to compress the control rod 69 and a load in a direction to expand the control rod 69 are applied alternately to the control rod 69 depending on the operation cycle of the engine. When the eccentric sleeve 134 is at the eccentric position on the rotary shaft 81', the rotating force from the control rod 69 toward one side and the rotating force toward the other side are also applied alternately to the control rod 69. Therefore, because the one-way clutch 139 is interposed between the eccentric sleeve 134 and the eccentric shaft 61', the eccentric sleeve 134 can be turned only in the direction opposite from the rotational direction 140 of the rotary shaft 81' depending on the application of the force from the control rod 69.

A third engagement projection 141 is integrally formed at an end of the cylindrical portion 134*a* of the eccentric sleeve 134 closer to the ratchet slider 136, to protrude radially outwards at circumferentially one point.

On the other hand, the ratchet slider 136 is spline-coupled to the rotary shaft 81' between the cylindrical portion 134*a* of the eccentric sleeve 134 and the fourth driven gear 132. Third and fourth locking portions 142 and 143 capable of being engaged alternatively with the third engagement projection 141 are integrally provided on a surface of the ratchet slider 136 opposed to the cylindrical portion 134*a*.

Figure 18:
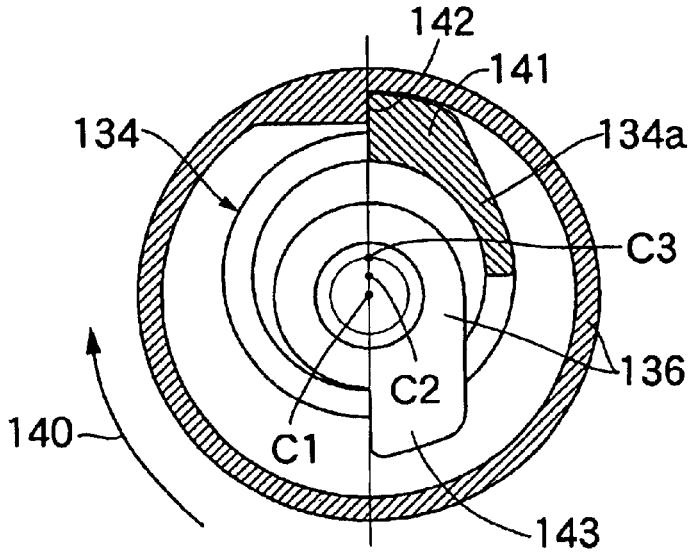
FIG. 18 is an enlarged sectional view taken along a line 18—18 in FIG. 16 in a high-load state of the engine.

Referring to FIG. 18, the third locking portion 142 is provided on an outer periphery of the ratchet slide 136, so that it is brought into engagement with the third engagement projection 141 in response to the rotation of the ratchet slider 136 slid toward the fourth driven gear 132 in the rotational direction 140 by the transmission of the rotating power from the crankshaft 27.

Figure 19:
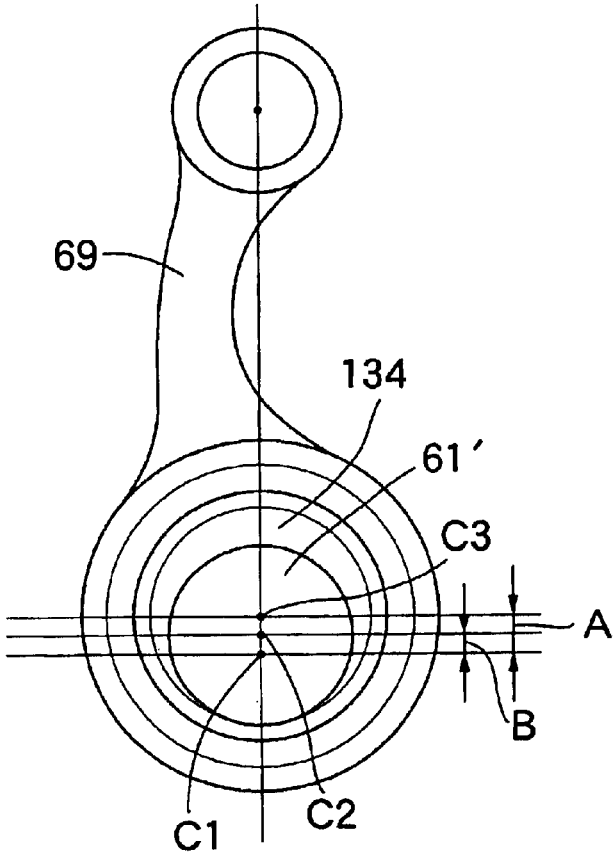
FIG. 19 is an enlarged sectional view taken along a line 19—19 in FIG. 16 in the high-load state of the engine.

In a state in which the third locking portion 142 has been brought into engagement with the third engagement projection 141 in the above manner, the rotational center C1 of the rotary shaft 81', the center C2 of the eccentric shaft 61' and the center of the eccentric sleeve 134, i.e., the support center C3 of the other end of the control rod 69 are at relative positions shown in FIG. 19. If the distance between the rotational center C1 of the rotary shaft 81' and the center C2 of the eccentric shaft 61' is represented by B, the distance A between the rotational center C1 of the rotary shaft 81' and the support center C3 of the other end of the control rod 69 is set so that an equation, $A=B\times 2$ is established.

Figure 20:
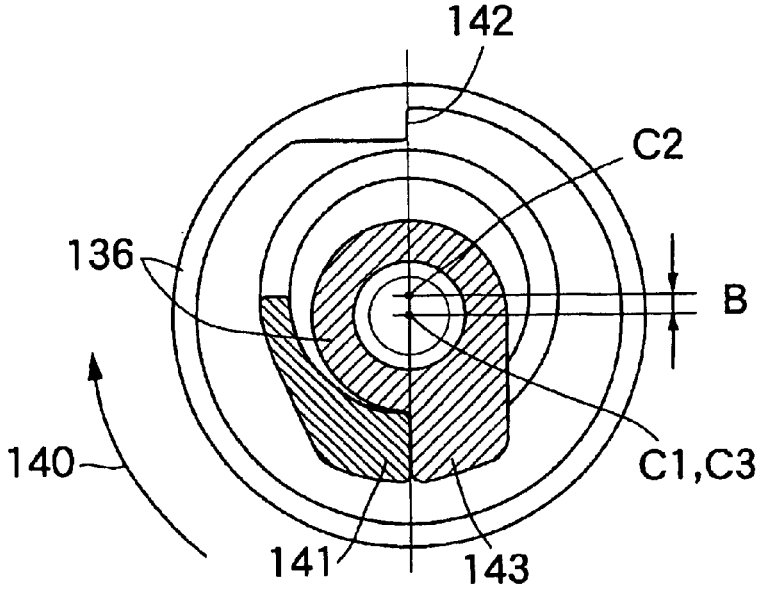
FIG. 20 is a sectional view similar to FIG. 18, but in a low-load state of the engine.

Referring to FIG. 20, the fourth locking portion 143 is provided on an inner periphery of the ratchet slider 136, so that it is brought into engagement with the third engagement projection 141 in response to the rotation of the ratchet slider 136 slid toward the eccentric sleeve 134 in the rotational direction 140 by the transmission of the rotating power from the crankshaft 27.

Figure 21:
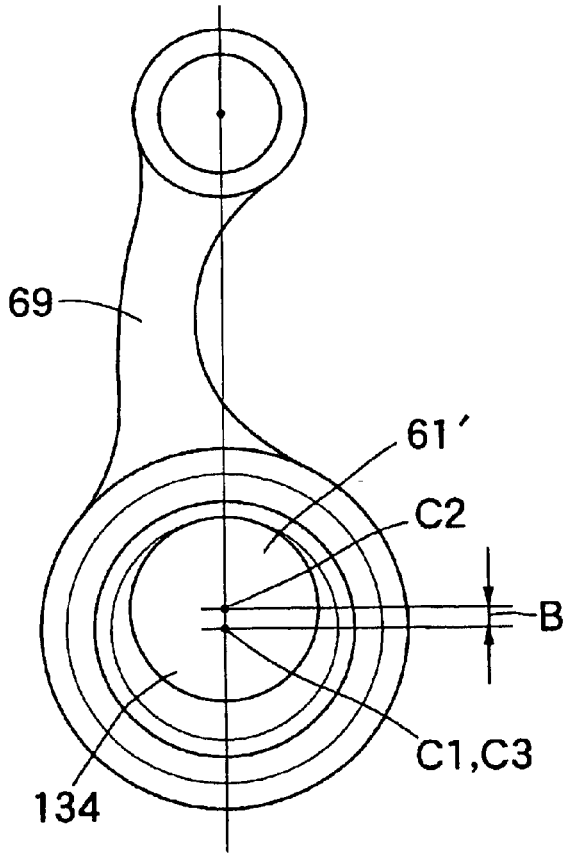
FIG. 21 is a sectional view similar to FIG. 19, but in the low-load state of the engine.

In a state in which the fourth locking portion 143 has been brought into engagement with the third engagement projection 141 in the above manner, the rotational center C1 of the rotary shaft 81', the center C2 of the eccentric shaft 61' and the center of the eccentric sleeve 134, i.e., the support center C3 of the other end of the control rod 69 are at relative positions shown in FIG. 21, and the rotational center C1 of the rotary shaft 81' and the support center C3 of the other end of the control rod 69 are at the same position. Namely, the third and fourth locking portions 142 and 143 are provided on the ratchet slider 136 at positions whose rotated phases are different from each other by 180 degree.

A bottomed cylindrical shaft-supporting portion 144 and a cylindrical shaft-supporting portion 145 are integrally provided on the case body 25' of the crankcase 22' so that they are opposed to each other at a distance on the same axis perpendicular to the axis of the rotary shaft 81'. The turn shaft 92' with one end disposed on the side of the shaft-supporting portion 144 is turnably carried on the shaft-supporting portions 144 and 145, and the other end of the turn shaft 92' protrudes outwards from the shaft-supporting portion 145.

The shift fork 138 is fixed by a pin 146 to the turn shaft 92' between the shaft-supporting portions 144 and 145. A pair of pins 148, 148 are embedded in the shift fork 138 so that they are engaged in an annular grooves 147 provided around the outer periphery of the shifter 137. Therefore, the shifter 137 is slid in an axial direction of the rotary shaft 81' by turning the shift fork 138 along with the turn shaft 92', whereby the alternative engagement of the third engagement projection 141 with the third or fourth locking portions 142 or 143 of the ratchet slider 136 is switched over.

Figure 22:
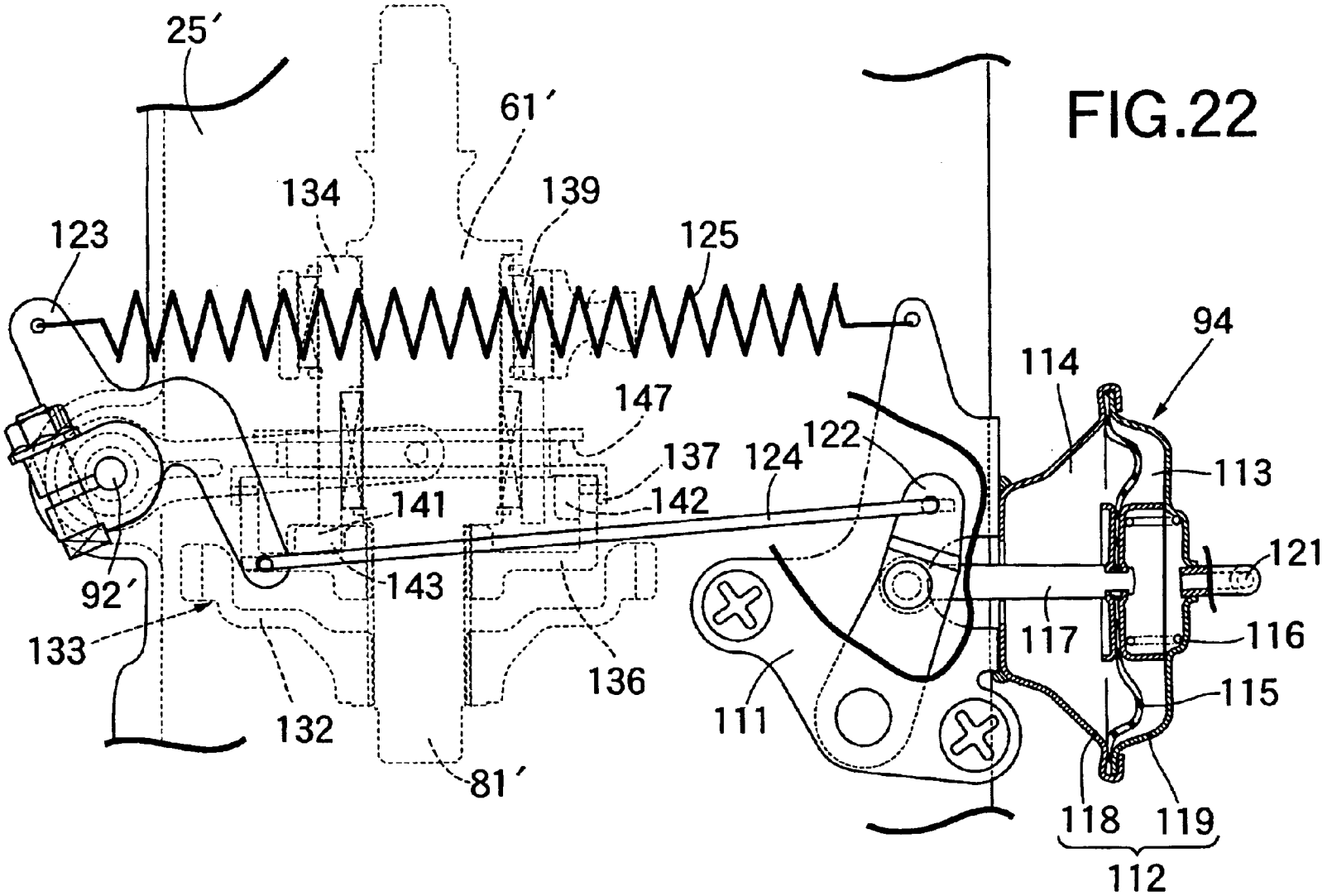
FIG. 22 is a partially cutaway plan view taken along a line 22—22 in FIG. 12 in the low-load state of the engine.
Figure 23:
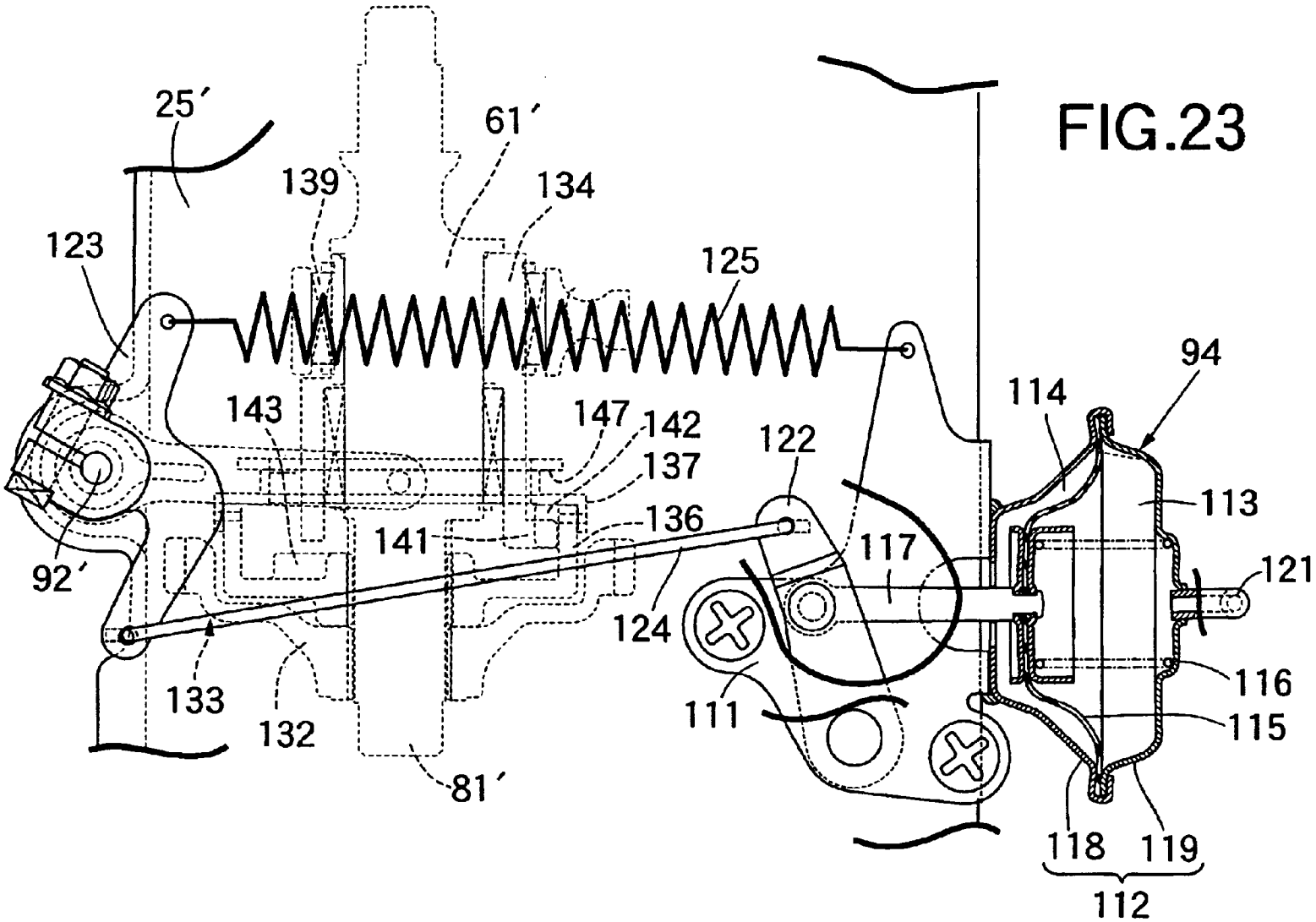
FIG. 23 is a view similar to FIG. 22, but in the high-load state of the engine.

Referring also to FIG. 22, the actuating rod 117 of the actuator 94 is connected to a driving arm 122 which is carried on a support plate 111 for turning about an axis parallel to the turn shaft 92'. A drive arm 123 is fixed to the other end of the turn shaft 92' protruding from the crankcase 22'. The driving arm 122 and the driven arm 123 are connected to each other through a connecting rod 124. A spring 125 for biasing the driven arm 123 to turn in a clockwise direction in FIG. 22 is mounted between the driven arm 123 and the support plate 111.

When the engine is in a low-load operational state in which the negative pressure in the negative pressure chamber is high, the diaphragm 115 has been flexed to decrease the volume of the negative pressure chamber 113 against the spring forces of the return spring 116 and the spring 125, so that the actuating rod 117 is contracted, as shown in FIG. 22. In this state, the turn shaft 92' and the shift fork 138 are at turned positions in which the ratchet slider 136 is in proximity to the eccentric sleeve 134 so that the third engagement projection 141 is engaged with the fourth locking portion 143.

On the other hand, when the engine is brought into a high-load operational state in which the negative pressure in the negative pressure chamber is low, the diaphragm 115 is flexed to increase the volume of the negative pressure chamber 113 by the spring forces of the return spring 116 and the spring 125, so that the actuating rod 117 is expanded. Thus, the turn shaft 92' and the shift fork 138 are at turned positions in which the ratchet slider 136 is in proximity to the fourth driven gear 132 so that the third engagement projection 141 is engaged with the third locking portion 143.

By turning the shift fork 138 by the actuator 94 in the above manner, the turning power of the crankshaft 27 is reduced to ½ and transmitted to the rotary shaft 81' in a state in which the support center C3 of the other end of the control rod 69 is aligned with the axis of the rotary shaft 81', i.e., the rotational center C1, during the low-load operation of the engine, and the turning power of the crankshaft 27 is reduced to ½ and transmitted to the rotary shaft 81' in a state in which the support center C3 of the other end of the control rod 69 is displaced from the axis of the rotary shaft 81', i.e., the rotational center C1, during the high-load operation of the engine.

The operation of the second embodiment will be described below. During the high-load operation of the engine, the eccentric shaft 61' is rotated at a rotational speed equal to ½ of that of the crankshaft 27 about the axis of the rotary shaft 81' in the state in which the support center C3 of the other end of the control rod 69 is displaced from the axis of the rotary shaft 81', i.e., the rotational center C1. Therefore, the position of the other end of the control rod 69 in the link mechanism 62 can be displaced through 180 degree about the axis of the rotary shaft 81' in the expansion stroke and the compression stroke, thereby providing a high expansion ratio in which the stroke of the piston 38 in the expansion stroke is larger than the stroke in the compression stroke, when the engine load is high.

On the other hand, during the low-load operation of the engine, the eccentric shaft 61' is rotated at a rotational speed equal to ½ of that of the crankshaft 27 about the axis of the rotary shaft 81' in the state in which the support center C3 of the other end of the control rod 69 is aligned with the axis of the rotary shaft 81', i.e., the rotational center C1. Therefore, when the engine load is low, the high compression ratio can be made constant.

In this way, the engine can be operated at the constant compression ratio when the engine load is low, and the engine can be operated at the high expansion ratio when the engine load is high. Thus, it is possible to further reduce the fuel consumption in the state in which the engine load is low, while providing a reduction in fuel consumption in the state in which the engine load is high.

In the second embodiment, the third and fourth locking portions 142 and 143 are provided on the ratchet slider 136 at the locations whose rotated phases are different from each other by 180 degree, but in the low-load operational state of the engine, a difference between the rotated phases of the third and fourth locking portions 142 and 143 may be set at a value smaller than 180 degree, while ensuring that the support center C3 of the other end of the control rod 69 is aligned with the axis of the rotary shaft 81', i.e., the rotational center C1.

Although the embodiments of the present invention have been described, it will be understood that the present invention is not limited to the above-described embodiments, and various modifications in design may be made without departing from the subject matter of the invention defined in the claims.

What is claimed is:

1. A variable stroke engine including: a connecting rod connected at one end to a piston through a piston pin; a subsidiary arm turnably connected at one end to the other end of the connecting rod and connected to a crankshaft through a crankpin; and a control rod connected at one end to the subsidiary arm at a position displaced from a connection position of the connecting rod; a support position of the other end of the control rod being capable of being displaced in a plane perpendicular to an axis of the crankshaft, wherein the engine further includes a switchover means capable of switching over: a state in which a high expansion ratio is provided such that the stroke of the piston in an expansion stroke is larger than that in a compression stroke when an engine load is high; and a state in which a constant compression ratio is provided when the engine load is low.

* * * * *